US005802440A

United States Patent [19]

Maeyama

[11] Patent Number: 5,802,440

[45] Date of Patent: Sep. 1, 1998

[54] CLEANING APPARATUS FOR CLEANING HEAT FIXING MEMBER, HEAT FIXING METHOD AND IMAGE FORMING METHOD

[75] Inventor: Ryuichiro Maeyama, Yokohama, Japan

[73] Assignee: Canon Kabushiki Kaisha, Japan

[21] Appl. No.: 674,241

[22] Filed: Jul. 1, 1996

[30] Foreign Application Priority Data

Jun. 30, 1995 [JP] Japan ..... 7-186474

[51] Int. Cl.[6] ..... G03G 15/20; G03G 13/08

[52] U.S. Cl. ..... 399/327; 399/324; 430/99; 430/109; 430/124

[58] Field of Search ..... 399/327, 324, 399/326, 302; 219/216; 430/124, 125, 99, 105, 107, 109; 15/1.51

[56] References Cited

U.S. PATENT DOCUMENTS

| | | | |
|---|---|---|---|
| 2,297,691 | 10/1942 | Carlson | 430/55 |
| 4,578,338 | 3/1986 | Gruber et al. | 430/120 |
| 4,579,802 | 4/1986 | Kishi et al. | 430/99 |
| 4,640,600 | 2/1987 | Hirabayashi et al. | 399/324 |
| 4,917,982 | 4/1990 | Tomono et al. | 430/99 |
| 4,921,771 | 5/1990 | Tomono et al. | 430/110 |
| 4,988,598 | 1/1991 | Tomono et al. | 430/99 |
| 4,990,424 | 2/1991 | Van Dusen et al. | 430/106.6 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,114,337 | 5/1992 | Yamazaki | 219/216 X |
| 5,187,526 | 2/1993 | Zaretsky | 399/302 |
| 5,250,998 | 10/1993 | Ueda et al. | 399/329 |
| 5,298,354 | 3/1994 | Matsunaga et al. | 430/99 |
| 5,378,743 | 1/1995 | Liedtke | 523/523 |
| 5,391,450 | 2/1995 | Nagatsuka | 430/99 |
| 5,529,873 | 6/1996 | Chiba | 430/109 |
| 5,563,695 | 10/1996 | Sakurai et al. | 399/327 |
| 5,600,431 | 2/1997 | Takeda et al. | 399/226 |

FOREIGN PATENT DOCUMENTS

| | | |
|---|---|---|
| 36-10231 | 7/1961 | Japan . |
| 42-23910 | 11/1967 | Japan . |
| 43-24748 | 10/1968 | Japan . |
| 52-3304 | 1/1977 | Japan . |
| 52-3305 | 1/1977 | Japan . |
| 56-13945 | 4/1981 | Japan . |
| 57-52574 | 11/1982 | Japan . |
| 58-199371 | 11/1983 | Japan . |
| 59-053856 | 3/1984 | Japan . |
| 59-061842 | 4/1984 | Japan . |
| 60-217366 | 10/1985 | Japan . |
| 60-252360 | 12/1985 | Japan . |
| 60-252361 | 12/1985 | Japan . |
| 61-094062 | 5/1986 | Japan . |
| 61-138259 | 6/1986 | Japan . |
| 61-273554 | 12/1986 | Japan . |
| 62-014166 | 1/1987 | Japan . |
| 1-109359 | 4/1989 | Japan . |
| 1-185660 | 7/1989 | Japan . |
| 1-185661 | 7/1989 | Japan . |
| 1-185662 | 7/1989 | Japan . |
| 1-185663 | 7/1989 | Japan . |
| 1-238672 | 9/1989 | Japan . |
| 2-079860 | 3/1990 | Japan . |
| 3-050559 | 3/1991 | Japan . |
| 3-212652 | 9/1991 | Japan . |
| 4-107467 | 4/1992 | Japan . |
| 4-149559 | 5/1992 | Japan . |
| 4-301853 | 10/1992 | Japan . |
| 5-061238 | 3/1993 | Japan . |
| 6-337540 | 12/1994 | Japan . |
| 6-337541 | 12/1994 | Japan . |
| 7-098511 | 4/1995 | Japan . |

OTHER PUBLICATIONS

Robert F. Fedors, A Method for Estimating Both the Solubility Parameters and Molar Volumes of Liquids, *Polymer Engineering and Science*, vol. 14, No. 2, Feb. 1974.

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A cleaning apparatus for cleaning a heat fixing member is disclosed which includes a cleaning member to be brought into contact with a surface of a heat fixing member, and a wax b held on the cleaning member. Also, a heat fixing method and an image forming method are disclosed which use the cleaning apparatus.

124 Claims, 5 Drawing Sheets

CLEANING APPARATUS FOR CLEANING HEAT FIXING MEMBER, HEAT FIXING METHOD AND IMAGE FORMING METHOD

BACKGROUND OF THE INVENTION

1. Field of the Invention

The present invention relates to a cleaning apparatus for cleaning a heat fixing member used for heat-fixing a toner image on a recording medium in an image forming method such as electrophotography, electrostatic recording or magnetic recording, or more particularly, to a cleaning apparatus useful for removing toner remaining on the heat fixing member after fixing, a heat fixing method using said cleaning apparatus, and an image forming method.

2. Related Background Art

Many electrophotographic methods are conventionally known as typically represented by those disclosed in the U.S. Pat. No. 2,297,691 specification, Japanese Patent Publication No. 42-23910, and Japanese Patent Publication No. 43-24748. In general, in these methods, a copy is obtained by using a photoconductive substance, forming an electric latent image on a photosensitive member by any of various means, then developing this latent image by the use of a toner, using direct or indirect means as required, transferring the toner image onto a recording medium such as a sheet of paper, and then fixing same by means of heating, pressure, heating pressure or solvent vapor. The toner remaining on the photosensitive member without being transferred to the recording medium is cleaned off by various methods, and these steps are repeated.

A common method of forming a full-color image is as follows. A photosensitive member of a photosensitive drum is uniformly charged by a primary charger, and the image is exposed to a laser beam modulated by a magenta image signal of the original to form an electrostatic latent image on the photosensitive drum. Then, this electrostatic latent image is developed by means of a magenta developing assembly containing a magenta toner, thereby forming a magenta toner image. Then, the magenta toner image developed on the photosensitive drum as described above by means of a transferring charger is transferred to a conveyed recording medium by direct or indirect means.

The photosensitive drum after development of the above-mentioned electrostatic latent image is, on the other hand, electrified again by means of the primary charger after removal of electricity by an electricity eliminating charger and cleaning with cleaning means. Similarly, a cyan toner image is formed and then transferred to a recording medium having the magenta toner image transferred, and further, a similar operation is carried out sequentially for yellow color, and then for black color to finally achieve transfer of a four-color toner image onto the recording medium. A full-color image is formed by fixing the recording medium having this four-color toner image under the effect of heat and pressure by means of fixing rollers.

An apparatus of this type is now applied not only as a copying machine for office uses for copying an original in general but also in areas of a printer for output of computer and a personal copying machine for personal uses.

In addition to these areas as typically represented by a laser beam printer, the apparatus is achieving a rapid progress in the area of ordinary-paper facsimile utilizing the basic engine.

There is therefore an increasing demand for a more compact size, a smaller weight, a higher speed, a more excellent image quality and a higher reliability, so that the machine is now composed of simpler components in various respects. As a result, a toner is required to have more sophisticated performance. An excellent machine cannot be built at present unless improvement of toner performance is successfully achieved. Along with the recent customer needs for diverse manners of duplication, demand for color copy is rapidly increasing: a further higher image quality and a higher resolution are demanded with a view to more accurately copying an original color image. From these points of view, a toner used for forming such a color image must be, when applied with heat, excellent in melting property and color mixing property, and it is desirable to use a toner having a low softening point, a low melting viscosity, and hence a higher sharp melt property.

More specifically, it is possible to expand the color reproducing range of a reproduction and obtain a color copy faithful to the original image by using such a sharp melt toner.

However, a color toner having such a high sharp melt property has a high affinity with fixing rollers in general, leading to a tendency of easy offsetting to the fixing rollers upon fixing.

Particularly in the case of a fixing apparatus in a color image forming apparatus, a plurality of toner layers including magenta, cyan, yellow and black layers on the recording medium, thus resulting in a tendency of easily causing an offset especially from the increase in the toner layer thickness.

For the purpose of preventing toner from adhering to the surface of the fixing rollers, it is the conventional practice to form the roller surface with a material excellent in releasability relative to the toner, such as silicone rubber or a fluoric resin, and coat the roller surface further with a thin film of a liquid having a high releasability such as silicone oil or fluoric oil with a view to preventing offset and fatigue of the roller surface.

However, this practice, while being very effective for preventing offset of the toner, requires an apparatus for feeding a liquid for preventing offset. This results in such problems as a more complicated construction of the fixing apparatus, and further, application of oil causes exfoliation between the layers composing the fixing rollers, this leading to a drawback of accelerating shortening of the service life of the fixing rollers. As the recording medium onto which the toner image is fixed by means of a fixing device, there are usually used various types of paper, coating paper and plastic films. Among others, the necessity of using, as a recording medium, a transparency film using an overhead projector (OHP) for presentation is now attracting the general attention. Unlike paper, for a reproduced transparency film presently available, application of oil inevitably causes sticky a feeling because of the low oil absorbing capacity, thus posing a difficult problem in quality of the resultant image. In addition, oil such as silicone oil is vaporized by heat, and it is highly probable that the vapor may cause such problems as contamination of the machine interior and treatment of collected oil.

From an idea to supply an offset preventing liquid during heating from the toner in place of a silicone oil supplying apparatus, a method is proposed which comprises adding a releasing agent such as low molecular weight polyethylene and, low molecular weight polypropylene into toner. Addition of such an additive in a large quantity to obtain a sufficient effect tends however to cause its filming onto the photosensitive member and contaminate the surface of a toner carrier such as a carrier or a sleeve, and causes a practical problem of deterioration of image quality. It is therefore a present common practice to add a releasing agent in a slight amount not causing deterioration of image quality and to use simultaneously an apparatus for the supply of some releasing type oil, an apparatus using a winding type member such as a web to take up offset toner, or an apparatus for cleaning using a cleaning pad. As the web, a nonwoven fabric containing aromatic polyamide resin and polyethylene terephthalate resin, impregnated with silicone oil (Japanese Patent Application Laid-Open No. 58-199371) has been used.

When silicone oil is supplied in a slight amount with the use of such nonwoven fabric impregnated with silicone oil, it is possible, in an ordinary use, to inhibit the sticky state on the transparency film caused by the application of the oil to an extent not posing a practical problem. However, because oil in an amount larger than in ordinary use is applied onto the first recording medium when image forming is restarted after interruption for a long period of time, a problem in the case where a transparency film is used as the recording medium is that the sticky feeling of oil still remains.

Furthermore, a low operability caused by silicone oil adhering to hands during replacement of the cleaning member is another problem, and silicone oil itself is expensive.

Moreover, sweepability or wiping property of the above-mentioned nonwoven fabric largely depends upon physical properties of silicone oil, and when a polymerized toner is used as the toner, the problem is a low sweepability resulting from a low affinity of silicone oil with the polymerized toner.

Particularly in the case of full color, the conventional means of adding a releasing agent to the toner poses another problem in that, when using a transparency film as the recording medium, high crystallization of the releasing agent and the difference in refractive index from that of the resin cause such problems as slightly degraded transparency and haze of the image after fixing.

Addition of a wax as the releasing agent to toner is known. This technique is disclosed, for example, in Japanese Patent Publication No. 52-3304, Japanese Patent Publication No. 52-3305 and Japanese Patent Application Laid-Open No. 57-52574.

Addition of wax to toner is disclosed also in Japanese Patent Application Laid-Open Nos. 3-50559, 2-79860, 1-109359, 62-14166, 61-273554, 61-94062, 61-138259, 60-252361, 60-252360, and 60-217366.

While wax is used for the purpose of improving offset resistance of toner at low temperatures or at high temperatures, or improving fixability at low temperatures, wax involves such problems as deterioration of blocking resistance, degradation of developability when exposed to heat upon temperature increase of, for example, a copying machine, and worsening of developability caused by wax migrating on the toner surface when holding the toner for a long period of time.

None of the conventional toner products satisfy all these requirements, suffering from some drawbacks or others. Some, being excellent in high-temperature offset and developability, are not sufficient in low-temperature fixability; some others, being excellent in low-temperature offset and low-temperature fixability, are slightly poor in blocking resistance and have developability degraded by temperature increase in the machine; in some others, offset resistance is not compatible between low and high temperatures, or the OHP projected image has the poorest transparency.

Particularly regarding transparency of an OHP projected image, there are made proposals of inhibiting crystallization of wax by adding a crystallization nucleating agent or the like to the wax (Japanese Patent Application Laid-Open Nos. 4-149559 and 4-107467); proposals of using wax itself having a low crystallization (Japanese Patent Application Laid-Open Nos. 4-301853 and 5-61238); and a proposal of improving surface smoothness of the toner layer after fixing by adding a substance having a satisfactory compatibility with a binder and a melting viscosity lower than that of the binder into the binder (Japanese Patent Application Laid-Open No. 3-212652).

As one of the releasing agents having a relatively high transparency and a low-temperature fixing performance, montan wax which is a mineral wax is available.

Using a wax having a molecular weight of about 800 and represented by the following formula:

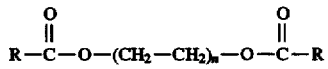

[where, R represents a hydrocarbon group of a carbon number of from 28 to 32, and n is an integer] is disclosed in Japanese Patent Application Laid-Open Nos. 1-185660, 1-185661, 1-185662, 1-185663, and 1-238672. These techniques are not however sufficiently satisfactory in transparency and haze (cloud value) of an OHP projected image.

In contrast, use of an ester-based wax of which the symmetricity of structure of the releasing agent is modified to hinder crystallization of the agent is proposed in Japanese Patent Application Laid-Open Nos. 7-98511, 6-337540 and 6-337541, giving rather successful results.

However, since full-color fixing apparatuses are now required to be excellent in durability and reliability, it is difficult to stably achieve for a long period of time an image forming method applicable to a high image-area image and a low image-area image as well as to an OHP projected image of full-color transparency film only through improvement of binder resins for toner and releasing agents unless the fixing apparatus is improved. Thus, further improvement of the apparatus is demanded.

SUMMARY OF THE INVENTION

The present invention has an object to provide a cleaning apparatus, a heat fixing method and an image forming method which solve the problems as described above.

Another object of the present invention is to provide a cleaning apparatus for a heat fixing member excellent in sweepability or wiping ability, a heat fixing method and an image forming method using the cleaning apparatus.

A further another object of the present invention is to provide a cleaning apparatus for a heat fixing member excellent in operability in replacement, a heat fixing method and an image forming method using the cleaning apparatus.

Further another object of the present invention is to provide a cleaning apparatus for a heat fixing member, which, when using a transparency film as the first recording medium upon restarting the image formation after interruption for a long period of time, gives a fixed image without a sticky feeling, a heat fixing method and an image forming method using the cleaning apparatus.

Further another object of the present invention is to provide a cleaning apparatus for a heat fixing member, which makes it difficult for fixing rollers to cause exfoliation and permits extension of the service life of the fixing rollers, a heat fixing method and an image forming method using the cleaning apparatus.

Further another object of the present invention is to provide a heat fixing method and an image forming method, which permit heat fixing and image forming with excellent low-temperature fixability and offset resistance relative to a recording medium for a long period of time.

Further another object of the present invention is to provide a heat fixing method and an image forming method which make it possible to obtain a high-grade full-color OHP sheet excellent in transparency.

Further another object of the present invention is to provide a cleaning apparatus for cleaning a heat fixing member, comprising a cleaning member to be brought into contact with the surface of a heat fixing member, and wax b held by the cleaning member.

Further another object of the present invention is to provide a heat fixing method comprising the steps of: causing a recording medium to carry a toner image formed by a toner; fixing the toner image carried on the recording medium onto the recording medium by bringing a heat fixing member into pressure contact with the toner image; and cleaning the surface of the heat fixing member by means of a cleaning apparatus; wherein the cleaning apparatus comprises a cleaning member to be brought into contact with the surface of the heat fixing member and wax b held by the cleaning member.

Further another object of the present invention is to provide an image forming method comprising the steps of: forming an electrostatic latent image on a latent image holding member; developing the electrostatic latent image by means of a toner to form a toner image; transferring the toner image onto a recording medium; fixing the toner image transferred onto the recording medium by means of a heat fixing member pressure-contacting with the toner image; and cleaning the surface of the heat fixing member by means of a cleaning apparatus; wherein the cleaning apparatus comprises the cleaning member which comes into contact with the surface of the heat fixing member and wax b held by the cleaning member.

DETAILED DESCRIPTION OF THE PREFERRED EMBODIMENT

Figure 1:
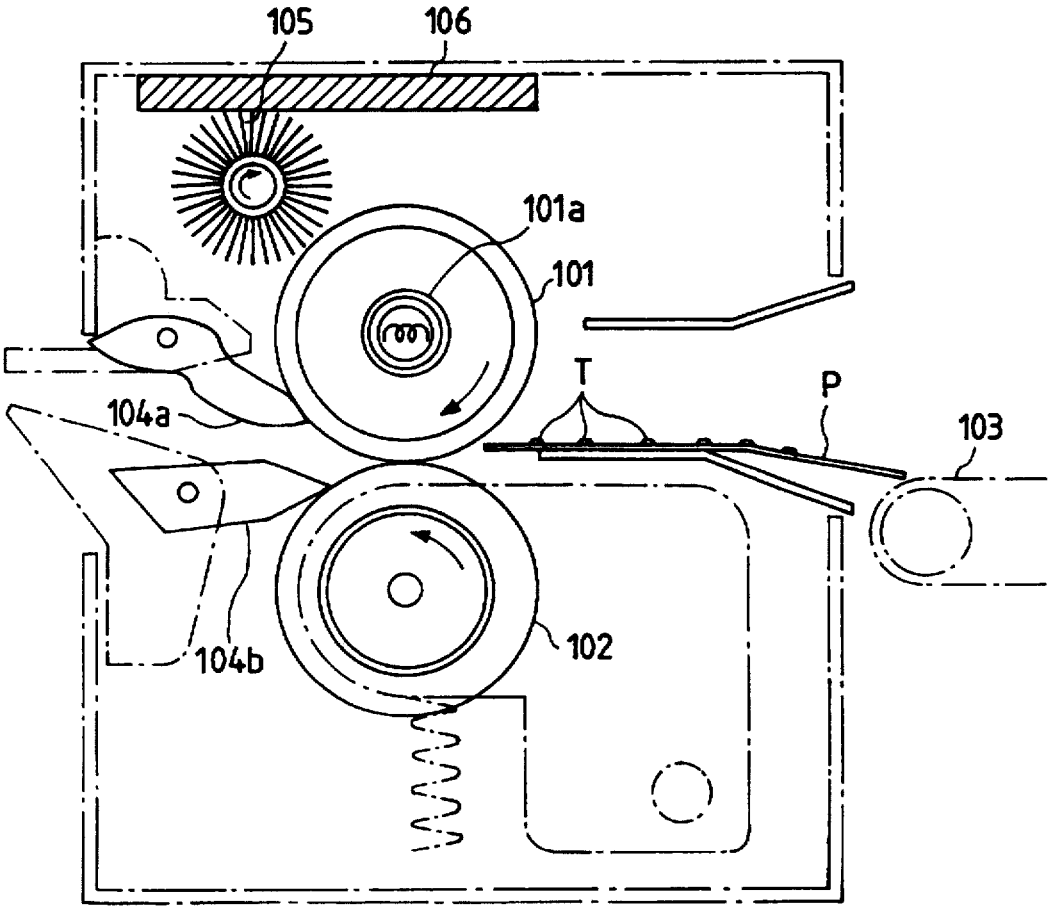
FIG. 1 is a schematic view illustrating an embodiment of the fixing apparatus of the roller heating type having the cleaning apparatus of the present invention.

The present inventors carried out extensive studies, and as a result, the following findings were obtained. More specifically, in a cleaning apparatus for cleaning the surface of a heat fixing member which heat-fixes a toner image onto a recording medium, wax b softens or melts through contact with a heat fixing member heated to a high temperature by causing a cleaning member in contact with the surface of the heat fixing member to hold wax b. Wax b which can flow so as to fill a gap between the cleaning member and the heat fixing member, permits close contact of the surface of the cleaning member with the surface of the heat fixing member, thus allowing display of an excellent effect of sweepability or wiping property relative to the surface of the heat fixing member. After fixing, furthermore, this softening or molten wax b solidifies. Therefore, even when a transparency film of OHP is used as a fixed recording medium, no sticky feeling is produced.

For wax b used in the invention, the melting point should preferably be within a range of from 30° to 150° C., or more preferably, within a range of from 50° to 120° C.

With a melting point of wax b of lower than 30° C., sticky feeling of a recording medium tends to be easily produced after fixing at the room temperature even when a recording medium hard to absorb molten wax such as a transparency film is used. Upon replacement of the cleaning member, furthermore, wax b is in solid state at the room temperature, providing an excellent operability as it does not adhere to, or contaminate operator's hands.

With a melting point of wax b of higher than 150° C., in order to ensure full display of functions of wax b as a releasing agent, a high fixing temperature must be set, which is not desirable from the point of view of energy saving. A sufficient time for melting is not provided for wax b having solidified at the room temperature. In the initial stage of power-on in the non-powered state kept for a long time, the heat fixing member may be damaged.

In the present invention, the melting point of wax is made the temperature corresponding to the value of main peak in an endothermic curve measured in a manner prescribed in ASTM D3418-8.

In the measurement based on ASTM D3418-8, for example, a Perkin-Elmer's DSC-7 is used. Melting points of indium and zinc are used for temperature correction of the detecting section of the apparatus, and the heat of melting of indium is used for correction of calorific value. An aluminum pan is used as sample. A vacant pan is set for control purposes, and measurement is carried out at a heating rate of 10° C./min and within a temperature range of from 20° to 20° C.

When wax b held by the cleaning member used in the invention has a contact angle C at 100° C. with the heat fixing member and a contact angle D at 200° C. with the heat fixing member, the contact angles C and D should preferably satisfy the following conditions:

$$60° \leqq C \leqq 80°,$$

and $$10° \geqq D-C \geqq 30°$$

or more preferably, the following conditions:

$$60° \leqq C \leqq 72°$$

$$9° \geqq D-C\ 4°$$

If the contact angle C at 100° C. between wax b and the heat fixing member of the fixing apparatus is within a range of from 60° to 80°, wettability of wax b relative to the heat fixing member of the fixing apparatus is on a proper level, so that, upon fixing the toner, all or part of wax b appropriately cover the heat fixing member, without offsetting of toner, and it is thus possible to fix toner onto the recording medium. When the difference between the contact angle C at 100° C. and the contact angle D at 200° C. is within a range of from 3° to 10°, it is possible to maintain a satisfactory offset resistance and extend the service life of the heat fixing member.

With a contact angle C of less than 60°, wax b is repulsed on the surface of the heat fixing member, and there is created a region in which the surface of the heat fixing member cannot be cleaned. In some regions, the releasing effect of wax b relative to the surface of the heat fixing member is not achieved. Durability of the heat fixing member as expressed in the number of fixed images decreases, simultaneously with a decrease in offset resistance.

With a contact angle C of more than 80°, wettability of wax b relative to the surface of the heat fixing member becomes too high, resulting in an excessively thin film of wax b formed on the surface of the heat fixing member. Wax b cannot sufficiently fill the gap between the cleaning member and the heat fixing member, resulting in a decrease in adherence between the cleaning member and the surface of the heat fixing member and in a poorer sweepability or wiping ability. During fixing, furthermore, the toner tends to push away the thin film of wax b and comes into direct contact with the surface of the heat fixing member, thus leading to a lower offset resistances With a value of contact angles D–C of less than 3°, melting viscosity of wax b becomes too lower and wax b tends to easily flow on the surface of the heat fixing member. This, in addition to the lowered releasability effect, causes wax to transfer in a large quantity toward the recording medium side upon fixing, producing stripes of wax b on the fixed image, and gloss uniformity may be reduced on the fixed image.

With a value of contact angles D–C of more than 10°, melting viscosity of wax b becoming too high raises adherence of the recording medium to the heat fixing member, tending to cause entanglement of the recording medium upon fixing.

Wax b used in the present invention should preferably have at least two peaks and/or shoulders in the molecular weight distribution based on double-column GPC, and preferably have a weight average molecular weight (Mw) within a range of from 400 to 4,000 and a number average molecular weight (Mn) within a range of from 200 to 4,000, or more preferably, an Mn within a range of from 400 to 3,000, or further more preferably, within a range of from 400 to 2,000, or further more preferably, from 200 to 2,000, or most preferably, from 200 to 1,500. Mn of wax b should more preferably be within a range of from 200 to 3,000, or further more preferably, from 200 to 2,000, or further more preferably, from 150 to 2,000, or most preferably, from 200 to 1,500.

When wax b has an Mw of less than 400 or an Mn of less than 200, low molecular weight components tend to cause contamination of the heat fixing member.

When wax b has an MW of more than 4,000 or an Mn of more than 4,000, crystallinity of wax b expresses, leading to a lower transparency.

In wax b used in the present invention, the ratio weight average molecular weight (Mw)/number average molecular weight (Mn) in the molecular weight distribution based on double-column GPC should preferably be up to 2, or more preferably, up to 1.45, or further more preferably, up to 1.30, in that the heat fixing member is not contaminated and offset hardly occurs.

With an Mw/Mn value of wax b of more than 2, the amount of transfer of low molecular weight components to the heat fixing member increases, thus causing offset and sticky feeling of an OHP sheet.

For wax b used in the present invention, the above-mentioned molecular weight distribution may be achieved with a single wax or by mixing two or more kinds of wax. Having the above-mentioned molecular weight distribution makes it possible to impair crystallinity and further improve transparency.

While there is no particular restriction on the method of blending two or more kinds of wax, applicable methods include melting-blending by using a media-type dispersing apparatus (ball mill, sand mill, attriter, apex mill, co-ball mill, handy mill) at a temperature higher than the melting points of the kinds of wax to be blended, and a method comprising dissolving the kinds of wax to be blended into a polymerizable monomer and blending by means of a media-type dispersing apparatus.

The solubility parameter (SP-value) of wax b used in the present invention should preferably be within a range of from 7.5 to 16.3, or more preferably, from 8.4 to 10.5, or further more preferably, from 8.5 to 10.0.

With an SP-value of wax b of less than 7.5, compatibility with the binder resin in toner becomes poorer, thus preventing transfer of toner to the cleaning apparatus.

With an SP-value of wax b of more than 10.5, on the other hand, hygroscopicity becomes higher and adsorbed water causes a decrease in the cleaning capacity.

Melting viscosity at 100° C. of wax b used in the present invention should preferably be within a range of from 1 to 50 mpas·sec, or more preferably, from 3 to 30 mpas·sec.

When melting viscosity of wax b is less than 1 mpas·sec, contamination of the heat fixing member is caused.

When melting viscosity of wax b is more than 50 mpas·sec, the additive of toner and paper powder are held on the surface portion of the cleaning member by molten wax having a high viscosity upon sliding friction with the heat fixing member, thus damaging the surface of the heat fixing member.

Vickers hardness of wax b used in the present invention should preferably be within a range of from 0.3 to 5.0, or more preferably, from 0.5 to 3.0.

A vickers hardness of wax b of less than 0.3 makes it difficult to control the amount of outflowing wax b, so that wax b rapidly flows out from the cleaning member, thus resulting in a decrease in cleaning function.

A Vickers hardness of wax b of over 5.0 also makes it difficult to control the amount of outflowing wax b, so that wax b cannot flow out from the cleaning member without taking much time and the cleaning function cannot be displayed.

The degree of crystallization of wax b used in the present invention should preferably be within a range of from 10 to 50%, or more preferably, from 20 to 35%.

With a degree of crystallization of wax b of less than 10%, a long holding causes oxidation and deterioration, making it impossible to maintain the cleaning capacity, and sticky feeling appears even at the room temperature.

With a degree of crystallization of wax b of more than 50%, transparency of an OHP image tends to worsen.

The kinds of wax b applicable in the present invention include, for example, paraffin-based wax, polyolefin-based wax, modified products thereof (such as oxides and graft-treated wax), higher fatty acid and metal salts thereof, amide wax, and ester-based wax.

Among others, ester wax is particularly preferable in that a high-grade full-color OHP image can be obtained.

The methods applicable for manufacturing ester wax preferably used as wax b in the present invention include, for example, synthesis based on oxidation reaction, synthesis from carboxylic acid and derivatives thereof, and ester group introducing reactions typically represented by Michael addition reaction. The particularly preferable methods for manufacturing wax used in the present invention are the method using dehydration-condensation reaction from a carboxylic acid compound and an alcohol compound as expressed by the following formula (1) and the reaction from a halide and an alcohol compound as expressed by the following formula (2):

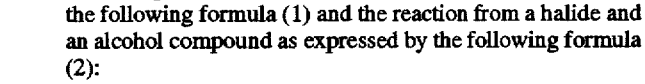

$$R_1—COOH+R_2(OH)_n \leftrightarrows R_2(OCO—R_1)_n+nH_2O \quad (1)$$

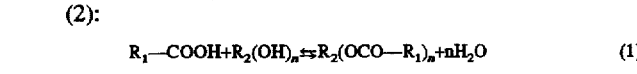

$$R_1—COCl+R_2(OH)_n \leftrightarrows R_2(OCO—R_1)_n+nHCl \quad (2)$$

where, $R_1$ and $R_2$ are organic groups such as alkyl group, alkenyl group, aralkyl group and aromatic group, and n represents an integer 1 to 4. The organic group should preferably has a carbon number of from 1 to 50, or more preferably, from 2 to 45, or further more preferably, from 4 to 30, and preferably be a straight chain.

In order to convert the above-mentioned ester equilibrium reaction into a generating system, alcohol in large excess is used, or reaction is caused in an aromatic organic solvent capable of being azeotropic with water using a Dean-Stark water separator. There is available another method of synthesizing polyester by adding a base as a recipient for an acid by-produced in an aromatic organic solvent by using an acid-halide compound.

The cleaning apparatus for a heat fixing member of the present invention is effective for a heat fixing member for fixing an image whether it is a monochromic image, a mono-color image or a full-color image.

For a full-color image, it is necessary to use three kinds of color-toner including magenta toner, cyan toner and yellow toner, or four kinds of color toner by adding black toner, and use a binder resin capable of sufficiently melting upon fixing to ensure sufficient mixing of these kinds of toner. At the time of toner fixing using such a binder resin, there remains much residual toner on the surface of the heat fixing member after fixing. Using the cleaning apparatus for a heat fixing member of the present invention is therefore effective.

Furthermore, it is desirable to use a toner containing wax a, as the toner used in the present invention, to improve the offset resistance relative to the heat fixing member upon fixing.

As a result of extensive studies, the present inventors obtained the following findings. When the contact angle A at 100° C. between wax a to be contained in the toner and the heat fixing member of the fixing apparatus is within a range of from 60° to 80°, wettabillty of wax a relative to the heat fixing member of the fixing apparatus is at an appropriate level. With a contact angle within this range, when preparing a full-color OHP excellent in transparency by melting the toner, all or part of wax a appropriately cover the heat fixing member. It is therefore possible to prepare a full-color OHP and achieve a satisfactory low-temperature fixability without causing toner offset. When the difference between the contact angle A at 100° and the contact angle B at 200° is within a range of from 3° to 10°, there is available a satisfactory offset resistance, permitting achievement of a longer service life of the heat fixing member.

When the contact angle at 100° C. between wax a contained in toner and the heat fixing member of the fixing apparatus is A, and that at 200° C. is B, the contact angles A and B should preferably satisfy the following relationship:

$$60° \leqq A \leqq 80°$$

$$10° \geqq B-A \geqq 3°$$

or more preferably, satisfy:

$$60° \leqq A \leqq 72°$$

$$9° \geqq B-A \geqq 4°.$$

With a contact angle A of less than 60°, wax a finely dispersed in the toner not as yet fixed or mutually dissolved with the binder aggregates again, resulting in a decrease in color reproducibility: or in transparency of the full-color OHP. With a contact angle A of more than 80°, uniformity in the heat fixing member is lost, thus leading to irregular fixing, production of partial offset and occurrence of defects in the resultant image.

When the value of contact angles B–A is less than 3°, compatibility of wax a relative to binding resin of toner decreases, reducing the fixing region and making it impossible to improve transparency of a full-color OHP. When the value of contact angles B–A is more than 10°, use of a recording medium having a large heat capacity such as a cardboard or a transparency leads to a large temperature variation of the surface layer of the heat fixing member. This causes a change in wettability of wax a relative to the heat fixing member, and an image having uniform gloss is unavailable.

Wax a contained in the toner used in the present invention should preferably be of a low crystallinity, having an appropriate affinity with the binder resin to achieve satisfactory low temperature fixability and offset resistance, a high hydrophobicity and a low melting point.

Wax a contained in the toner used in the present invention should preferably have two or more peaks and/or shoulder in the molecular weight distribution based on double-column GPC, and have a weight average molecular weight (Mw) within a range of from 400 to 4,000 and a number average molecular weight (Mn) within a range of from 200 to 4,000. Mw of wax a should preferably be within a range of from 400 to 3,000, or more preferably, from 400 to 2,000, or further more preferably, from 200 to 2,000, or most preferably, from 200 to 1,500. Mn of wax a should preferably be within a range of from 200 to 3,000, or more preferably, from 200 to 2,000, or further more preferably, from 150 to 2,000, or most preferably, from 200 to 1,500.

With an Mw of wax a of less than 400 or an Mn of less than 200, blocking resistance of toner is seriously degraded. With an Mw of wax a of more than 4,000 or an Mn of more than 4,000, crystallinity of wax itself expresses and transparency is seriously degraded.

The ratio weight average molecular weight (Mw)/number average molecular weight (Mn) of wax a contained in toner used in the present invention in the molecular weight distribution based on double-column GPC should preferably be up to 1.45, or more preferably, up to 1.30 from the point of view of uniformity of the fixed image, satisfactory transfer property, and prevention of contamination of contact-charing means for coming into contact with the photosensitive member for charging.

A value of Mw/Mn of wax a of more than 1.45, the reduced toner fluidity tends to cause gloss irregularities of the fixed image, and further, decrease in transferability of toner and contamination of the contact charging member tend to be easily caused.

For wax a contained in the toner used in the present invention, the above-mentioned molecular weight distribution may be achieved with a single kind of wax, or by mixing two or more kinds of wax. Achievement of this molecular weight distribution makes it possible to impair crystallinity and permits further improvement of transparency.

No particular restriction is imposed on the method of blending two or more kinds of wax. Applicable methods include melting-blending by using a media-type dispersing apparatus (ball mill, sand mill, attriter, apex mill, co-ball mill, handy mill) at a temperature higher than the melting points of the kinds of wax to be blended, and a method comprising dissolving the kinds of wax to be blended into a polymerizing monomer and blending by means of a media-type dispersing apparatus. The additive at this point may be a pigment, a charge control agent, or a polymerization initiator.

The solubility parameter (SP-value) of wax a contained in the toner used in the present invention should preferably be within a range of from 7.5 to 16.3, or more preferably, from 8.4 to 10.5, or further more preferably, from 8.5 to 10.0. With an SP-value of wax a of less than 7.5, compatibility with the binder resin used is poor, resulting in difficulty in achieving satisfactory dispersion into the binder resin, and hence, in a narrower fixing region, as well as in impossibility to obtain a sufficient transmissivity of the full-color transparency. With an SP-value of wax a of more than 10.5, on the other hand, a long storage of toner tends to cause toner blocking. In addition, a very high compatibility between the binder resin and wax a makes it difficult to form a sufficient releasing layer between the fixing member and the toner binder resin layer, thus easily causing offset phenomenon.

In order to obtain a sufficiently transparent OHP image with a low heat capacity of the fixing apparatus, it is important to reduce crystallinity of wax a to be contained in the toner and wax b to be held by the cleaning member. Even after usual fixing, presence of partially unmelted toner grain boundaries and irregular reflection of light resulting from crystallinity of the wax layer may reduce valid transmissivity of light, and hence lead to a decrease in haze. Furthermore, even when the components mixed into the toner are sufficiently melted upon fixing, a large difference in refractive index between the toner layer after melting and the wax layer formed between the fixing members may cause irregular reflection of light, which is not desirable.

Increased irregular reflection of light leads to a decrease in brightness of the projected image and in clearness of colors. Particularly when using a reflection-type overhead projector, the drawback is more serious than in using a transmission-type overhead projector.

More specifically, in order to achieve a lower crystallinity of wax a and b, it is important to reduce the degree of crystallization of the individual wax a and b. In order to prevent presence of non-melted toner grain boundaries in the fixed toner layer, contrivances are necessary to cause the glass transition temperature (Tg) of binder resin and the melting point (mp) of wax a and b to meet each other as far as possible, and with a view to ensuring rapid melting with a small amount of energy, the material should preferably have a small melting enthalpy ($\Delta H$) which is the latent heat of wax a and b. So that the molten wax layer rapidly transfer to between the binder resin layer and the heat fixing member or is present there and forms an offset preventive layer, it is desirable to appropriately adjust the solubility parameter (SP) difference between the binder resin and wax a and b.

Embodiments preferred from these points of view are described below in detail.

In the present invention, preferable binder resins for toner include polyester-based resins, styrene-acryl-based resins epoxy-based resins and styrene-butadiene-based resins. The wax a and b should preferably have a refractive index close to that of these resins.

The difference in refractive index between the binder resin and wax a and b should be up to 0.18 at a temperature of 25° C., or more preferably, up to 0.10. A difference in refractive index of more than 0.18 should be avoided because of the tendency to lead to a lower transparency of the OHP image, and particularly to a lower brightness of a half-tone projected image.

The melting point of wax a contained in the toner used in the present invention should preferably be within a range of from 30° to 150°C., or more preferably, from 50° to 120° C. A melting point of wax a of less than 30° C. tends to reduce the blocking resistance of the toner, sleeve contamination controllability upon copying on a great number of sheets, and contamination resistance of the photosensitive member. With a melting point of wax a of higher than 150° C., manufacture of toner by the pulverizing process requires excessively large energy for uniformly mixing with the binder resin, and in manufacture of toner by the polymerization process, there are limitations on the use of a larger-scale apparatus and the quantity of mutual dissolution in raising viscosity for uniform mixing with the binder resin, resulting in difficulty in adding a large quantity.

Melting viscosity at 100° C. of wax a contained in toner used in the present invention should preferably be within a range of from 1 to 50 mpas·sec, or more preferably, from 3 to 30 mpas·sec. With a melting viscosity of wax a of lower than 1 mpas·sec, when coating the sleeve with a thin layer of toner by means of a toner layer thickness regulating member which regulates the toner layer thickness by the use of elastic force such as an elastic blade in the one-component development process, a mechanical shifting force tends to lead to sleeve contamination, or even in the application of the two-component development process, a shifting force between the toner and the carrier upon developing the toner with the use of the carrier tends to cause damages, resulting in easy occurrence of burying of an external additive or toner crushing. With a melting viscosity of wax a of more than 50 mpas·sec, the dispersoid has a too high viscosity when manufacturing a toner by the polymerization process: it is thus difficult to obtain a toner of a fine and uniform particle size, tending to result in a toner showing a wide particle size distribution.

Vickers hardness of wax a contained in the toner used in the present invention should preferably be within a range of from 0.3 to 5.0, or more preferably, from 0.5 to 3.0.

A toner containing wax a having a Vickers hardness of less than 0.3 tends to be crushed at the cleaning portion of the copying machine when copying on a great number of sheets, leading to easy fusion and adherence of toner onto the drum surface, thus resulting in easy occurrence of black stripes on the image. In addition, when storing a plurality of image samples by piling up, the toner tends to transfer to the back to form a drawback known as back-copy. A toner containing wax a having a Vickers hardness of more than 5.0 requires application of a large pressure for the fixing apparatus used upon heat-fixing. It is therefore necessary to make an unnecessarily high strength design for the fixing apparatus. If a fixing apparatus of an ordinary pressurizing force is used for fixing, there occurs a decrease in offset resistance.

The degree of crystallization of wax a contained in the toner used in the present invention should preferably be within a range of from 10 to 50%, or more preferably, from 20 to 35%.

With a degree of crystallization of wax a of less than 10%, preservation property and fluidity of toner tend to deteriorate. A degree of crystallization of wax a of more than 50% tends to lead to deterioration of transparency of the OHP image.

Applicable kinds of wax a contained in the toner used in the present invention include, for example, paraffin-based wax, polyolefin-based wax, modified products thereof (for example, oxides and graft-treated products), higher fatty acids, and metal salts thereof, amide wax, and ester-based wax.

Among others, ester wax is particularly preferable in that a high-grade full-color OHP image is available.

An ester wax favorably applicable as wax a in the present invention should preferably be prepared by the same manufacturing process as that for ester wax favorably applicable as wax b described above.

The blending ratio of wax a should preferably be within a range of from 1 to 40 parts by weight relative to 100 parts by weight of the binder resin of the toner, or more preferably, from 2 to 30 parts by weight.

In the pulverizing process for manufacturing a toner which comprises melting, mixing and kneading a mixture comprising a binder resin, a coloring agent and wax a, then cooling and crushing the product, and classifying it to obtain toner particles, the amount of added wax a should preferably be within a range of from 1 to 10 parts by weight relative to 100 parts by weight binder resin, or more preferably, from 2 to 7 parts by weight.

In the polymerizing process for manufacturing a toner which comprises polymerizing a mixture comprising a polymerizable monomer, a coloring agent and wax a, thereby directly obtaining toner particles, the amount of added wax a should preferably be within a range of from 2 to 40 parts by weight relative to 100 parts by weight of the polymerizable monomer or resin synthesized through polymerization of the polymerizable monomer, or more preferably, from 5 to 30 parts by weight; most preferable, from 10 to 20 parts by weight.

In the polymerizing toner manufacturing process, as compared with the pulverizing toner manufacturing process, toner particles tend to contain much wax in the polymerization in an aqueous medium because of the polarity of wax a lower than that of the binder resin, thus making it possible to use a larger amount of wax a, and this is particularly effective for preventing offset upon fixing.

When the amount of blended wax a is smaller than the lower limit, the offset preventing effect tends to decrease, and when it is larger than the upper limit, on the other hand, the blocking resistance effect degrades and an adverse effect tends to be exerted on the offset resistance effect: fusion adherence to the drum and to the sleeve easily occur. Particularly in the case of the polymerizing toner manufacturing process, there is a tendency to produce a toner of a wide particle size distribution.

Binder resins applicable In the toner of the present invention include, for example:

homopolymers of styrene or substitution products thereof such as polystyrene, poly-p-chlorostyrene and polyvinyltoluene; styrene-based copolymers such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-methyl-α-chloromethacrylate, styrene-acrylonitrile copolymer, styrene-vinylmethyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride; phenolic resin; natural modified phenolic resins; natural resin modified maleic acid resin; acrylic resin; methacrylic resin; polyvinyl acetate; silicone resin; polyester resin; polyurethane; polyamide resin; furan resin; epoxy resin; xylene resin; polyvinylbutyral; terpene resin; cumarone-indene resin; and petroleum-based resins. Preferable binding substances include styrene copolymers and polyester resins.

As a comonomer to styrene monomer of a styrene-based copolymer, any of the following vinyl monomers is used singly or two or more in combination: monocarboxylic acids having a double bond and substitution products thereof such as, for example, acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substitution products thereof such as maleic acid, butyl maleate, methyl maleate and dimethyl maleate; vinylesters such as vinyl chloride, vinyl acetate, and vinyl benzoate; ethylene-based olefins such as ethylene, propylene and butylene; vinyl-ketones such as vinylmethylketone and vinylhexylketone; and vinyl ethers such as vinylmethylether, vinylethylether and vinylisobutylether.

In the present invention, the number average molecular weight of THF-soluble fraction of binding resin of toner should preferably be within a range of from 3,000 to 1,000,000.

The styrene-based polymer or the styrene-based copolymer may be crosslinked, or further, may be a resin mixture containing crosslinked and non-crosslinked resins.

The crosslinking agent of the binding resins may be mainly a compound having two or more double bonds which are pplymerizable. Applicable crosslinking agents include aromatic divinyl compounds such as divinyl benzene and divinyl naphthalene; carboxylic esters having two double bonds such as ethylene glycol diacrylate, ethylene glycol dimethacrylate, 1,3-butadiol dimethacrylate; divinyl compounds such as divinyl aniline, divinyl ether, divinyl sulfide and divinyl sulfone; and compounds having three or more vinyl groups. These may be used singly or in combination.

The amount of crosslinking agent should preferably be within a range of from 0.001 to 10 parts by weight relative to 100 parts by weight polymerizable monomer.

The toner of the present invention may contain a charge control agent.

Any of the following substances is applicable for controlling the toner to a negatively chargeable one.

For example, organic metal compounds and chelate compounds are effective, and preferably applicable ones further include monoazo-metal compounds, acetylacetone-metal compounds, aromatic hydroxy-carboxylic acids, and aromatic dicarboxylic acid-metal compounds. In addition, applicable compounds include aromatic hydroxycarboxylic acid, aromatic mono- and polycarboxylic acid, metal salts thereof, anhydrides thereof, esters thereof, and phenol derivatives thereof such as bisphenol; urea derivatives; metal-containing salicylic acid compounds; metal-containing naphthoic acid-based compounds; boron compounds; quaternary ammonium salts; carixarene; silicon compounds; styrene-acrylic acid copolymer; styrene-methacrylic acid copolymer; styrene-acryl-sulfonic acid copolymer; and non-metal carboxylic acid-based compounds.

Any of the following substances is applicable for controlling the toner to a positively chargeable one.

For example, Nigrosine; modified products based on fatty acid metal salts; guanidine compounds; imidazole compounds; quaternary ammonium salts such as tributylbenzene ammonium-1-hydroxy-4-naphthosulfonic acid salts and tetrabutyl ammonium tetrafluoroborate, onium salts such as phosphonium salts similar thereto and lake pigments of quaternary ammonium salts or onium salts; and triphenylmethane dye and lake pigments thereof (applicable laking agents include: phosphotungstic acid, phosphomolybdic acid, phosphotungstic-molybdic acid, tannic acid, lauric acid, gallic acid, ferricyanides, ferrocyanides); metal salts of higher fatty acid; diorgano-tin-oxides such as dibutyl-tin-oxide, dioctyl-tin-oxide, and dicyclohexyl-tin-oxide; and diorgano-tin-borates such as dibutyl-tin-borate, dioctyl-tin-borate, and dicyclohexyl-tin-borate. Any of these substances may be used singly or two or more thereof in combination. Among others, charge control agents such as Nigrosin-based substances and quaternary ammonium salts can favorably be applied because of satisfactory startup of charging.

Any of these charge control agents should preferably be used in An amount within a range of from 0.01 to 20 parts by weight relative to 100 parts by weight of the resin components of the toner, or more preferably, from 0.1 to 10 parts by weight, or further more preferably, from 0.2 to 4 parts by weight.

The coloring agents for the toner used in the present invention include as the black coloring agent, carbon black or a magnetic material, the following yellow coloring agents, magenta coloring agents or cyan coloring agents which are toned into black.

Applicable yellow coloring agents include condensed azo compounds, isoindolinone compounds, anthraquinone, azo metal complexes, and methine compounds. More specifically, C.I. pigment yellow 12, 13, 14, 15, 17, 62, 74, 83, 93, 94, 95, 109, 110, 111, 128, 129, 147, 168 or 180 can be appropriately applied.

Applicable magenta coloring agents include condensed azo compounds, diketopyrrolopyrrole compounds, anthraquinone, quinacridone compounds, basic dye lake compounds, naphthol compounds, benzimidazolone compounds, Thioindigo compounds and perylene compounds. More specifically, C.I. pigment red 2, 3, 5, 6, 7, 23, 48:2, 48:3, 48:4, 57:1, 81:1, 144, 146, 166, 169, 177, 184, 185, 202, 206, 220, 221 or 254 can be favorably applied.

Applicable cyan coloring agents include copper phthalocyanine compounds and derivatives thereof, anthraquinone compounds, and basic dye lake compounds. More specifically, C.I. pigment blue 1, 7, 15, 15:1, 15:2, 15:3, 15:4, 60, 62 or 66 can be favorably used. These coloring agents can be used singly, in mixture or in the form of a solid solution. In the present invention, the coloring agent is selected with due regard to hue angle, colorfulness or chroma, brightness or lightness, weather resistance, OHP transparency, and dispersibility into toner. In the toner used in the present invention, the amount of coloring agent should preferably be within a range of from 1 to 20 parts by weight relative to 100 parts by weight of the resin.

Further in the present invention, a magnetic toner containing a magnetic material can be used as the toner. In this case, the magnetic material may also take the role of a coloring agent.

In the present invention, applicable magnetic materials to be contained in the magnetic toner include, for example, iron oxides such as magnetite, hematite and ferrite; metals such as iron, cobalt and nickel, alloys thereof with such metals as aluminum, cobalt, copper, lead, magnesium, tin, zinc, antimony, beryllium, bismuth, cadmium, calcium, manganese, selenium, titanium, tungsten, and vanadium, and mixture thereof.

The magnetic material used in the present invention should preferably be surface-improved. When obtaining a magnetic toner by the application of the polymerizing toner manufacturing process, it is desirable to achieve surface improvement by means of a surface improving agent comprising a substance not detrimental to polymerization relative to the polymerizable monomer, and applicable surface improving agents include, for example, silane coupling agent and titanium coupling agent.

The ferromagnetic material as the magnetic material should preferably have an average particle size of up to 2 μm, or more preferably, within a range of from about 0.1 to 0.5 μm.

The amount of the magnetic material to be contained in the magnetic toner should preferably be within a range of from 10 to 200 parts by weight relative to 100 parts by weight of the resin component, or more preferably, from 20 to 100 parts by weight.

Magnetic properties of the magnetic material as measured in 10K oersted application should preferably include a coercive force (Hc) of from 20 to 300 oersted, a saturated magnetization ($\sigma s$) of from 50 to 200 emu/g, and a residual magnetism ($\sigma r$) of from 2 to 20 emu/g.

The particle size of an additive for imparting various toner properties should preferably be up to ⅕ the volume average particle size of toner particles. The particle size of this additive means the average particle size thereof as determined from surface observation of the toner particles through an electron microscope. Applicable additives added for the purpose of imparting these properties include the following substances.

Applicable fluidity imparting agents include, for example, metal oxides such as silicon oxide, aluminum oxide and titanium oxide; carbon black; and carbon fluoride. These substances should preferably be hydrophobicity-treated.

Applicable grinding agents include, for example, metal oxides such as strontium titanate, cerium oxide, aluminum oxide, magnesium oxide and chromium oxide; nitrides such as silicon nitride; carbides such as silicon carbide; and metal salts such as calcium sulfate, barium sulfate and calcium carbonate.

Applicable lubricants include, for example, fluorine resin powder such as vinylidene fluoride and polytetrafluoroethylene; and fatty acid metal salts such as zinc stearate and calcium stearate.

Applicable charge control particles include, for example, metal oxides such as tin oxide, titanium oxide, zinc oxide, silicon oxide and aluminum oxide; and carbon black.

The amount of these additives should preferably be within a range of from 0.1 to 10 parts by weight relative to 100 parts by weight of the toner particles, or more preferably, from 0.1 to 5 parts by weight. These additives may be used singly or a plurality thereof may be used simultaneously.

Now, the method of manufacturing the toner used in the present invention is described. The toner used in the invention may be manufactured by the application of the crushing toner manufacturing process or the polymerizing toner manufacturing process.

In the present invention, the crushing toner manufacturing process comprises the steps of sufficiently mixing a binder resin, a wax a, a pigment, a dye or a magnetic material as a coloring agent, a charge control agent as required, and other additives in a mixing apparatus such as a Henshel mixer or a ball mill; melting, mixing and kneading the resultant mixture by means of a heat kneader such as heat rolls, a kneader or an extruder to disperse or dissolve metal compounds, the pigment, the dye and the magnetic material in a mass resulting from mutual dissolution of resin components; cooling, solidifying, crushing and classifying the resultant kneaded mass, thereby obtaining a toner.

The toner used in the present invention can be obtained also by sufficiently mixing a toner and desired additives as required in a mixer such as a Henshel mixer.

The polymerizing toner manufacturing methods applicable in the present invention include, for example, a method of obtaining spherical toner particles by atomizing a molten mixture in the open air, using a disk or a multifluid nozzle, as disclosed in Japanese Patent Publication No. 56-13945; a method of directly producing toner particles by using a suspension polymerization process as disclosed in Japanese Patent Publication No. 36-10231, Japanese Patent Application Laid-Open Nos. 59-53856 and 59-61842; an emulsion polymerization method typically represented by a dispersion polymerization method of directly producing toner particles using an aqueous organic solvent not requiring a polymer available in a form soluble in a monomer or a soap-free polymerization method of producing toner particles through direct polymerization in the presence of an aqueous polar polymerization initiator; and a method of manufacturing a toner by using a hetero-aggregation method of previously preparing a primary polar emulsion polymerized particles, and then adding polar particles having an opposite charge for association.

Among others, the method of producing toner: particles through direct polymerization of a monomer composition containing at least a polymerizable monomer, a coloring agent and a wax a is particularly preferable.

In the dispersion polymerizing method, however, while the resultant toner exhibits a very sharp particle size distribution, the choice of materials is tight, and use of an organic solvent poses such problems as disposal of waste solvent and ignition of solvent, thus tending to lead to a complicated and troublesome manufacturing apparatus. Consequently, the method of producing toner particles by directly polymerizing a monomer composition containing at least a polymerizable monomer, a coloring agent and a wax in an aqueous medium is preferable. However, the emulsion polymerizing method as represented by soap-free polymerization, while being effective for obtaining a relatively orderly arranged particle size distribution, tends to degrade environmental properties when the emulsifier used or the terminal of the initiator is present on the toner particle surfaces.

The suspension polymerizing process under the atmospheric pressure or under application of a pressure is particularly preferable, in which a fine particle toner having a sharp particle size distribution can easily be obtained, in the present invention. Furthermore, the process known as the seed polymerizing process comprising causing once obtained polymerized particles further to adsorb a monomer, and then causing polymerization with the use of a polymerization initiator can be favorably applied.

A preferred form of the toner used in the present invention is the one in which wax a is enveloped by an outer shell resin layer, as observed by the sectional surface measuring method of toner using a transmission-type electron microscope (TEM). In view of the necessity to add much wax a to the toner from the point of view of fixability, it is desirable to envelope wax a with the outer shell resin layer for ensuring preservation and fluidity of the toner. Without an envelope, dispersion of wax a in toner cannot be uniform, resulting in a wider particle size distribution, and this tends to easily cause fusion adherence of toner to the apparatus. A concrete method of enveloping wax a comprises setting polarity of the material in the aqueous medium to a value smaller for wax a than for the main monomer, and adding higher-polarity resin or monomer in a small amount, thereby achieving a toner having a structure known as a core shell in which wax a is covered with an outer shell resin layer. Particle size distribution and particle size of the toner can be controlled by using a method of altering the kind and the amount of addition of a hard-water-soluble inorganic salt or a dispersant serving to exert protection colloid effect, or by controlling equipment conditions including stirring conditions such as rotor circumferential velocity, pass frequency and shape of the stirring blade, or the shape of the vessel, or the solid concentration in the aqueous solution, thereby obtaining the prescribed toner of the present invention.

The toner sectional surface is measured in the present invention by a method comprising sufficiently dispersing toner in a cold curing epoxy resin, curing same for two days in an atmosphere at 400°C., dyeing the resultant cured product with the use of triruthenium tetroxide, or as required, with the simultaneous use of triosmium tetroxide, cutting samples in flakes with the use of a microtome provided with diamond teeth, and using a transmission-type electron microscope (TEM) to measure the sectional shape of toner. In the present invention, it is desirable to use triruthenium tetroxide dyeing method to make a contrast between materials by the utilization of the slight difference in the degree of crystallization between the wax a and the resin composing the outer shell resin.

When using the direct polymerization method for the manufacture of the toner of the present invention, it is actually possible to manufacture the toner by the following procedure, which comprises adding a wax a, a coloring agent, a charge control agent, a polymerization initiator and other additives to a monomer, uniformly dissolving or dispersing the mixture by means of a dispersing machine such as a homogenizer or an ultrasonic dispersing machine, and dispersing the resultant monomer mixture into an aqueous phase containing a dispersion stabilizing agent by means of an ordinary stirrer or a stirrer such as a homomixer or a homogenizer. The stirring velocity and stirring time should preferably be adjusted so that the monomer, liquid drop has a size equal to that of the desired toner particle. Therefore, it suffices to conduct stirring to such extent that the state of particles is maintained and sedimentation of particles is prevented under the effect of the dispersion stabilizing agent. The polymerization temperature should be at least 40°C., or preferably, within a range of from 50° to 90° C. Temperature may be increased in the latter half of polymerizing reaction, and the aqueous medium should preferably be removed partially by distillation in the latter half of reaction or after the end of reaction to eliminate unreacting polymerizable monomer and by-products causing bad odor upon toner fixing. After the completion, the produced toner particles are washed, collected through filtration, and dried. In the suspension polymerizing method, it is desirable to use water in an amount of usually 300 to 3,000 parts by weight relative to 100 parts by weight of the monomer system together with the dispersant medium.

When directly obtaining a toner by the application of the polymerizing method, applicable polymerizable monomers include styrene-based monomers such as styrene, o(m-,p-)-methylstyrene, and m(p-)-ethylstyrene; (meth)acrylic ester-based monomers such as methyl (meth)acrylate, ethyl (meth)acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl-(meth) acrylate, dimethylaminoethyl (meth)acrylate, and diethylaminoethyl (meth)acrylate; and ene-based monomers such as butadiene, isoprene, cyclohexane, (meth)acrylonitrile and acrylamide.

In order to form a toner of a core shell structure in the present invention, it is desirable to use simultaneously a polar resin. Polar resins such as polar polymers and polar copolymers applicable in the present invention are as shown below.

Such polar resins include polymers of nitrogen-containing monomers such as dimethylaminoethyl methacrylate and diethylaminoethyl methacrylate or copolymers of nitrogen-containing monomers and styrene-unsaturated carboxylic esters; nitrile-based monomers such as acrylonitrile; halogen-based monomers such as vinyl chloride; unsaturated carboxylic acids such as acrylic acid and methacrylic acid; unsaturated dibasic acids; unsaturated dibasic anhydrides; polymers of nitro-based monomers and copolymers thereof with styrene-based monomers; polyester; and epoxy resins. More preferable are copolymer of styrene and (meth) acrylic acid, maleic acid copolymers, saturated polyester resin and epoxy resin.

Applicable polymerization initiator include, for example, azo- or diazo-based polymerization initiator such as 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile and azobisisobutylonitrile; peroxide-based initiator such as benzoylperoxide, methylethylketone peroxide, diisopropylperoxycarbonate, cumenhydroperoxide, t-butylhydroperoxide, di-t-butylperoxide, di-cumil-peroxide, 2,4-dichlorobenzoylperoxide, lauroylperoxide, 2,2-bis (4,4-t-butylperoxycyclohexyl)propane, and tris-(t-butylperoxy) triazine; macromolecular initiators having peroxides on the side chain; persulfuric salts such as potassium persulfate and ammonium persulfate; and hydrogen peroxide. These may be used singly or two or more kinds thereof may be used simultaneously.

The amount of added polymerization initiator should preferably be within a range of from 0.5 to 20 parts by weight relative to 100 parts by weight of the polymerizable monomer.

For the purpose of controlling the molecular weight in the present invention, a known crosslinking agent or chain transfer agent may be added, and the amount of addition should preferably be within a range of from 0.001 to 15 parts by weight relative to 100 parts by weight of the polymerizable monomer.

In the present invention, an appropriate inorganic compound or an organic compound stabilizing agent should preferably be used as a dispersing medium used when manufacturing a polymerized toner by a polymerizing process through emulsifying polymerization, dispersion polymerization, suspension polymerization, seed polymerization or hetero-aggregation process. Applicable inorganic compound stabilizing agents include, for example, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Applicable organic compound stabilizing agents include, for example, sodium salts of polyvinyl alcohol, gelatine, methylcellulose, methylhydroxypropylcellulose, ethylcellulose and caroxymethylcellulose, polyacrylic acid and salts thereof, starch, polyacrylamide, polyethyleneoxide, poly (hyroxystearic-g-methyl methacrylate-eu-methacrylic acid) copolymer, nonionic or ionic surfactants.

When using the emulsion polymerization or hetero-aggregation, an anionic surfactant, a cationic surfactant, an amphoteric surfactant or a nonionic surfactant is used as a stabilizing agent. The amount of stabilizing agent should preferably be within a range of from 0.2 to 30 parts by weight relative to 100 parts by weight of the polymerizable monomer.

Of these stabilizing agents, when using an inorganic compound, a commercially available one may be directly used. To obtain fine particles, however, a stabilizing agent of an inorganic compound may be produced in a dispersant medium.

With a view to achieving fine dispersion of the stabilizing agent, a surfactant may be used in an amount within a range of from 0.001 to 0.1 parts by weight relative to 100 parts by weight of the polymerizable monomer. This surfactant is for promoting the stabilizing function of the above-mentioned dispersed stabilizing agent. Applicable surfactants include, for example, sodium dodecylbenzene sulfonate, sodium tetradecyl sulfate, sodium pentadecyl sulfate, sodium octyl sulfate, sodium oleate, sodium laureate, potassium stearate and calcium oleate.

When using a coloring agent for the polymerized toner in the present invention, due regard should be given to the polymerization inhibitory property and the aqueous phase transfer property of the coloring agent. The coloring agent should preferably be subjected to surface modification such as, for example, a hydrophobicity treatment free from a polymerization inhibiting effect. It should particularly be noted that a dye-based coloring agent or carbon black has a polymerization inhibitory effect in many cases. A dye-based agent should preferably be surface-treated by a method comprising previously polymerizing a polymerizable monomer in the presence of the dye, and adding the resultant colored polymer to the monomer system. Carbon black may be treated with a substance reactive with the surface functional group of carbon black such as polyorganosiloxane, apart from a treatment similar to that for a dye as described above.

For the toner used in the present invention, the difference in SP-value between wax a or b and the binder resin should preferably be appropriate as described above. More specifically, the SP-value of the binder resin should be higher than that of the wax a or b, and the difference in SP-value should preferably be within a range of from 6.0 to 15.0, or more preferably, from 7.0 to 14.0.

With a difference in SP-value between wax a and the binder resin of less than 6.0, wax a tends to come out on the surface, resulting in a decrease in preservation of toner and also in contamination of the charging member. With a difference in SP-value between wax a and the binder resin of more than 15.0, on the other hand, dispersibility (compatibility) of wax a in the binder resin deteriorates, and along with this, dispersibility of the coloring agent is also impaired, thus making it difficult to obtain a toner having a uniform coloring ability.

With a difference in SP-value between wax b and the binder resin of less than 6.0, affinity of wax b with the toner containing the binder resin increases, causing the cleaned toner to melt, which is mixed with wax b, and the mixture adhering to the surface of the heat fixing member may lead to color mixing.

With a difference in SP-value between wax b and the binder resin of more than 15.0, on the other hand, affinity of wax b with the toner containing the binder resin decreases, thus reducing the cleaning property.

The SP-value of the binder resin should preferably be within a range of from 16 to 24, or more preferably, from 17 to 23.

An SP-value of the binder resin of less than 16 degrades startup caused by contact with a charging member such as a carrier, resulting in fog or toner splashing.

When the SP-value of the binder resin is more than 24, on the other hand, the charging ability of toner decreases especially under a high humidity, leading to deterioration of image quality.

The melting point of wax a or b should be higher than the glass transition temperature of the binder resin, and the temperature difference should preferably be up to 100° C., or more preferably, up to 75° C., or further more preferably, up to 50° C.

If the difference in temperature between the melting point of wax and the glass transition temperature of the binder resin is higher than 100° C., low-temperature fixability is reduced. As a very slight temperature difference leads to a smaller temperature region in which preservation and high-temperature offset resistance of toner are compatible with each other, the difference in temperature between the melting point of wax and the glass transition temperature of binder resin should preferably be at least 2° C.

When the temperature difference between the melting point of wax b and the glass transition temperature of binder resin is higher than 100° C., there is a deterioration of cleaning property. Since a very slight temperature difference between the melting point of wax b and the glass transition temperature of binder resin leads to a decreased preservation of a fixed image, this difference should preferably be at least 2° C.

The glass transition temperature of binder resin should preferably be within a range of from 40° to 90° C., or more preferably, from 50° to 85° C.

A glass transition temperature of binder resin of lower than 40° C. results in a decreased toner preservation and a lower fluidity, thus making it impossible to obtain a satisfactory image.

A glass transition temperature of binder resin of higher than 90° C. corresponds to a poorer low-temperature fixability, and in addition, to a degraded transmissivity of full-color transparency. Particularly, the half-tone portions darken, thus tending to give a projected image poor in color tone.

In the present invention, the temperature difference between the melting point of wax a contained in the toner and the melting point of wax b used in the cleaning apparatus should preferably be up to |75° C.|, or more preferably, up to |50° C.|, or further more preferably, equal to each other.

When the melting point of wax b is higher by more than 75° C. than the melting point of wax a, leaching or bleeding of wax held by the cleaning member is not sufficiently accomplished at the fixing temperature at which wax a sufficiently functions as the releasing agent, and a desired cleaning property cannot be displayed.

When the melting point of wax b is lower by more than 75° C. than the melting point of wax a, the melting viscosity of wax b becomes too lower at the fixing temperature at which wax a sufficiently functions as the releasing agent, and as a result, the heat fixing member tends to be contaminated.

In the present invention, the toner can be used for any of a one-component type developing agent and a two-component type developing agent.

In the case of a magnetic toner in which a magnetic material is contained in a toner, as a one-component developing agent, a method is available, which consists of accomplishing transportation and charging of magnetic toner by the use of a magnet built in the development sleeve.

When using a non-magnetic toner not containing a magnetic material as a one-component developing agent, there is available a method comprising transporting the toner by causing the toner to adhere onto the development sleeve forcedly friction-charged by the use of a blade and a fur brush.

When using a two-component developing agent, a carrier is used, together with the toner. While there is no particular restriction on the carrier used in the present invention, the carrier is basically composed of a single or composite ferrite comprising any of the oxides of such metals as iron, copper, zinc, nickel, cobalt, manganese, and chromium. The carrier shape is an important factor because of the possibility to widely controlling saturated magnetization and electric resistance: it is desirable to select a spherical, flat or indeterminate shape and further control detailed structure of the carrier surface condition including, for example, surface irregularities.

Methods of obtaining a carrier applicable in the present invention include a method of previously; producing carrier core particles by calcining and granulating any of the above-mentioned metal oxides and coating the particles with a resin, a method of obtaining a low-density inorganic oxide dispersion carrier by kneading, crushing and classifying inorganic oxides and a resin with a view to alleviating the load of carrier on the toner, and further a method of obtaining a spherical inorganic oxides dispersion carrier by directly causing suspension polymerization of a kneaded mixture of inorganic oxides and a monomer in an aqueous medium.

Particularly preferable is the above-mentioned method of coating the carrier surface with a resin. Practices applicable thereto include the one comprising causing a coating material such as a resin to dissolve or suspend in a solvent, and depositing the product onto the carrier, and the conventional one comprising coating the carrier with a resin such as simply mixing with powder.

Depending upon the toner material, applicable coating materials for the carrier surface include, for example, polytetrafluoroethylene, monochlorotrifluoroethylene polymer, polyvinylidene fluoride, silicone resin, polyester resin, metal compound of ditertiary butyl salicylic acid, styrene-based resins, acryl resins, polyamide, polyvinyl butyral, Nigrosine, aminoacrylate resins, basic dye and lakes thereof, fine silica powder, and fine alumina powder. These materials are appropriately used singly or in combination.

The amount of treatment (coating) of the above-mentioned coating materials should preferably be within a range of from 0.01 to 30 wt. %, or more preferably, from 0.1 to 20 wt. %.

The average particle size of these carriers should preferably be within a range of from 10 to 100 μm, or more preferably, from 20 to 50 μm.

Particularly preferable embodiments comprise a coated ferrite carrier prepared by (i) coating a ferrite surface with a mixture of a fluorine resin and a styrene based resin (for example, a combination of polyvinylidene fluoride and styrene-methylmethacrylate resin, a combination of polytetrafluoroethylene and styrene-methylmethacrylate resin, or a combination of a fluorine copolymer and a styrene-based copolymer), preferably at a ratio of 90:10 to 20:80, or more preferably, of 70:30 to 30:70, or (ii) coating a ferrite surface with a silicone resin preferably in an amount of 0.01 to 5 wt. %, or more preferably, of 0.1 to 3 wt. %.

An applicable fluorine copolymer is vinylidene fluoride-tetrafluoroethylene copolymer (10:90 to 90:10). Applicable styrene-based copolymers include styrene-acrylic acid 2-ethylhexyl copolymer (20:80 to 80:20), and styrene-acrylic acid 2-ethylhexyl-methyl methacrylate copolymer (20 to 60:5 to 30:10 to 50).

The above-mentioned coated ferrite carrier has a sharp particle distribution and has functions of providing a satisfactory friction-charging property to the toner used in the present invention, and improving electrophotographic properties.

When preparing a two-component developing agent by mixing toner and carrier in the present invention, a mixing ratio as expressed in the toner concentration in the developing agent within a range of from 2 to 15 wt. %, or preferably, from 4 to 13 wt. % gives satisfactory results. A toner concentration of less than 2% leads to a lower image concentration, and a toner concentration of more than 15% results in an increase in fog and splashing in the apparatus, thus reducing the service life of the developing agent.

The following magnetic properties are preferable for a carrier: the saturated magnetization should preferably be within a range of from 20 to 90 $Am^2/kg$, or more preferably for achieving a higher picture quality, from 30 to 70 $Am^2/kg$. With a saturated magnetization of more than 90 $Am^2/kg$, it becomes difficult to obtain a toner image of a high image quality. When the saturated magnetization of less than 20 $Am^2/kg$, there is a decrease in magnetic constraint, thus easily causing carrier adherence.

The methods for measuring various physical properties in the present invention are described below.

(1) Contact angle

In the present invention, the contact angles A, B, C and D are measured by forming a thin flake of the surface layer material of the heat fixing member (into a thickness of about 5 mm) by the application of the liquid drop method with the use of model CA-X made by Kyowa Kaimen Kagaku Company.

(2) Molecular weight distribution

In the present invention, the molecular weight distribution of wax a and b is measured by GPC under the following conditions:

(GPC measuring conditions)

Equipment: GPC-150C (made by Waters Company)

Column: GMH-HT30 cm in two columns (made by Toso Company)

Temperature: 135° C.

Solvent: o-dichlorobenzene (0.1% ionol added)

Flow velocity: 1.0 ml/min

Sample: 0.4 ml of 0.15% sample injected.

After measurement under the conditions described above, the molecular weight of the sample is calculated by the use of a molecular weight calibration curve prepared by means of a monodispersive polystyrene standard sample. In addition, the molecular weight is calculated by polyethylene-converting the result in accordance with a calculation formula derived from Mark-Houwink viscosity formula.

(3) Solubility parameter

Solubility parameter (SP-) values for the wax a, b and the binder resin in the present invention was calculated in accordance with Fedors' method [Polym. Eng. Sci., 14(2) 147(1974)] using additivity of atomic groups.

(4) Melting viscosity

In the present invention, melting viscosity of wax a and b was measured by a method using a cone plate type rotor (PK-1) on VT-500 manufactured by HAAKE Company.

(5) Vickers hardness

In the present invention, hardness of wax a and b was measured by a method using, for example, Shimazu Dynamic Ultramicro Hardness Meter (DUH-200). Measurement comprised using a Vickers pressurizer, causing the sample to displace by 10 μm under a load of 0.5 g at a loading rate of 9.67 mg/sec, holding the sample for 15 seconds and analyzing a dent formed on the sample, thereby determining Vickers hardness. The sample was prepared by forming a previously melted sample by using a die having a diameter of 20 mm into a cylinder having a thickness of 5 mm.

(6) Degree of crystallization

In the present invention, the degree of crystallization of wax a and b was determined by the use of the following calculation formula from the area ratio of the noncrystalline scattering peak to crystalline scattering peak, without using a calibration curve:

Degree of crystallization (%)=[Amount of crystalline components]/[Total amount of components]

An applicable measuring instrument is the Rotor Flex RU300 (Cu target, point focus, output 50 kV/250 mA) made by Rigaku Denki Company. Measurement is based on the transmission-rotation method, with a measuring angle $2\theta=5°$ to 35°.

(7) Refractive index

In the present invention, refractive index of the binder resin and wax a and b was measured by a method comprising preparing solid samples having dimensions of length (20 to 30)×width (8)×thickness (3 to 10), applying a slight amount of brome naphthalene to the prism surface to improve the adhesion with the prism surface, and placing a solid sample thereon, thereby measuring the refractive index. An applicable measuring instrument includes, for example, Appe Refractometer 2T made by Atago Company.

(8) Glass transition temperature

In the present invention, the glass transition temperature (Tg) was measured with reference to ASTM D3418-8, by the use of, for example, DSC-7 made by Perkin-Elmer Company. Temperature at the detecting section of the apparatus was corrected by means of the melting points of indium and zinc, and calorific value was corrected by the use of fusion heat of indium. Sample measurement was conducted by using an aluminum pan and setting an empty pan for control purposes, with a heating rate of 10° C./min within a temperature range of from 20° to 200° C.

Now, an appropriate heat fixing apparatus to which the cleaning apparatus of the present invention is applicable is described below.

In the present invention, the heat fixing member in contact with a toner image of the heat fixing apparatus is to come into contact with the toner image on the recording material and impart heat for fixing the toner image onto a recording medium. This heat fixing member comprises (i) a heating roller which is a roller-shaped member, which comes into contact with the toner image in the heat roller fixing system, and imparts heat of heating means provided therein to the toner image; (ii) a fixing film which is a film-shaped member, which comes into contact with the toner image in the film heat fixing system, and imparts heat of heating means provided on the face of the film-shaped member opposite to the face in contact with the toner image to the toner image; and (iii) a fixing film which is a film-shaped member, which comes into contact with the toner image in the film heat fixing system, and imparts heat generated from electromagnetic induction heat generation of the film-shaped member itself under the effect of magnetic field to the toner image.

FIG. 1 is a schematic view of an embodiment of the heat fixing apparatus of the roller heat fixing system having the cleaning apparatus of the present invention.

The apparatus of this embodiment is provided with a cylindrical heating roller 101 having heating means such as a heater 101*a* therein, and upon fixing, this heating roller 101 rotates clockwise.

In FIG. 1, 102 is a pressurizing roller which is a cylindrical pressure rotating body. Upon fixing, this pressurizing roller 102 comes into contact with the heating roller 101 under pressure, and rotates anticlockwise.

The recording medium P as a heated member onto which the unfixed toner T has been deposited as the toner image is transported by a conveying belt 103 from the right (upstream side) in FIG. 1. Through pressurizing and heating at the pressure-contact portion between the heating roller 101 and the pressurizing roller 102, the unfixed toner image carried on the recording medium P is fixed onto the recording medium P by the heating roller 101 serving as the heat fixing member in pressure-contact with this toner image and then discharged to the left (downstream) direction in FIG. 1.

Also in FIG. 1, 104*a* and 104*b* are separation claws provided to prevent the recorded medium P from being entrapped by the heating roller 101 or the pressurizing roller 102 and from causing a defective transfer.

The cleaning apparatus of the present invention is used to clean the surface of the heating roller 101 by coming into contact therewith.

Now, the cleaning apparatus of the present invention is described below.

Also in FIG. 1, 106 is a felt-like wax pad impregnated with the above-mentioned wax b. A heat-resistant non-woven fabric is impregnated with wax b up to saturation at a temperature at which wax b is melted. Fibers applicable for this heat-resistant non-woven fabric include meta-type and para-type aromatic polyamide fiber, polyamide-imide fiber, aromatic polyetheramide fiber, polyphenylenesulfide fiber, polybenzoimidazole fiber, polyester fiber, and polyamide fiber: one or more kinds of these fibers may be used. While there is no particular restriction on the size or fineness and length of the staple of the heat-resistant fibers, one with a size within a range of from 0.5 to 20 denier and a staple length within a range of from 5 to 150 mm can be favorably applied. Carbon fiber or a conductivity-treated fiber may be mixed with these heat-resistant fibers and imparted them with conductivity. In the case where this sheet is a non-woven fabric, the fiber sheet may comprise one or two layers so far as at least the layer in contact with the surface to be cleaned is impregnated with wax.

A silicone rubber or fluorine rubber sponge may be used as a material to be impregnated with wax b. As wax b is not impregnated into closed-cell foams, open-cell foams are preferable.

Reference numeral 105 represents a cleaning roller onto which brush fibers as cleaning members are planted into a cylindrical shape. The cleaning roller 105 removes toner residues adhering to the circumferential surface of the heating roller by rotating, and appropriately feeds wax b.

More specifically, the cleaning apparatus of the present invention comprises: (i) a cleaning roller 105 serving as a cleaning member, and (ii) wax b melted or softened by the heat of the cleaning roller 105 heated by the contact of wax b impregnated into the wax pad 106 with the circumferential surface of the heating roller 101 and adhering to, and held by the cleaning roller 105.

The heating roller 101 comprises, for example, an aluminum pipe having a thickness of about 2 to 5 mm, serving as the core, coated with silicone rubber or Teflon on the circumferential surface thereof into a thickness of from 200 to 500 μm.

The pressurizing roller 102 comprises, for example, an SUS pipe having a diameter of about 10 mm, serving as the core, coated with silicone rubber on the circumferential surface thereof into a thickness of about 3 mm.

Figure 6:
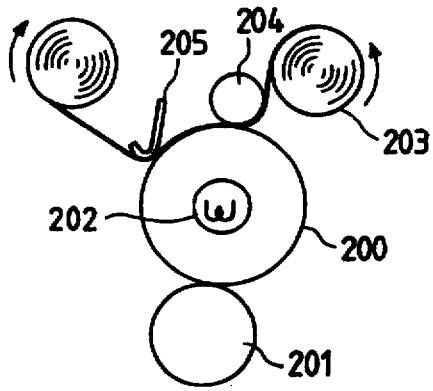
FIG. 6 is a schematic view illustrating an embodiment of a fixing apparatus of the roller heating type having the cleaning apparatus of another form of the present invention.

FIG. 6 is a schematic view illustrating another embodiment of the heat fixing apparatus using another embodiment of the cleaning apparatus of the present invention described by means of FIG. 1.

In the heat fixing apparatus shown in FIG. 6, the cleaning roller of the roller heat fixing apparatus shown in FIG. 1 is replaced by a cleaner using a web 203, comprising the web 203, a web holding roller 204 and a web guide 205.

The web 203 is fed out by the rotation of a driving motor not shown. As a result of feeding of the web 203 at a rate of 0.05 mm/run, it comes into contact with a fixing roller 200 which is a heat fixing member and displacement thereof removes toner residues adhering to the circumferential surface of the fixing roller 200, while appropriately feeding wax b. The amount of feed of the web 203 is controlled by the rotation of the motor not shown with the amount for one passage of an A4 width recording paper as standard.

The fixing roller 200 having therein a heat source 202 comprises, for example, an iron pipe having a thickness of from 0.55 to 1.5 mm and a diameter of about 40 mm, serving as the core, coated with silicone rubber, fluorine rubber or fluorine resin into a thickness of from several ten μ to several hundred μ on the circumferential surface thereof.

The pressurizing roller 201 comprises, for example, a solid iron core having a diameter of about 20 mm, coated with silicone rubber into a thickness of about 5 mm over the core, and with fluorine resin as the outermost layer.

Furthermore, the cleaning apparatus of the present invention is applicable also to a heat fixing apparatus of the film heat fixing type in place of the above-mentioned roller heat fixing type heat fixing apparatus.

As compared with the other known types of heat fixing such as heat roller, heat plate, belt heating, flash heating and oven heating-types, the heat fixing apparatus of the film heat fixing type has the following advantages and is effective: (1) because of the possibility of using a low heat capacity linear heating member as the heating member and a thin film of a low heat capacity as the film, it is possible to save electric power and to reduce the waiting time (quick starting property), and in addition, to inhibit temperature increase in the apparatus; and (2) as it is possible to independently set a fixing point and a separating point, offset can be prevented; and it is possible to solve various defects in the apparatus of the other types.

The heat fixing apparatus of the film heating type is applicable, not only to a fixing apparatus, but also as, for example, an apparatus for heating a recording medium carrying an image to modify the surface properties, or widely as means or apparatus for heat-treating a material to be heated, such as an apparatus for provisionally fixing.

Figure 2:
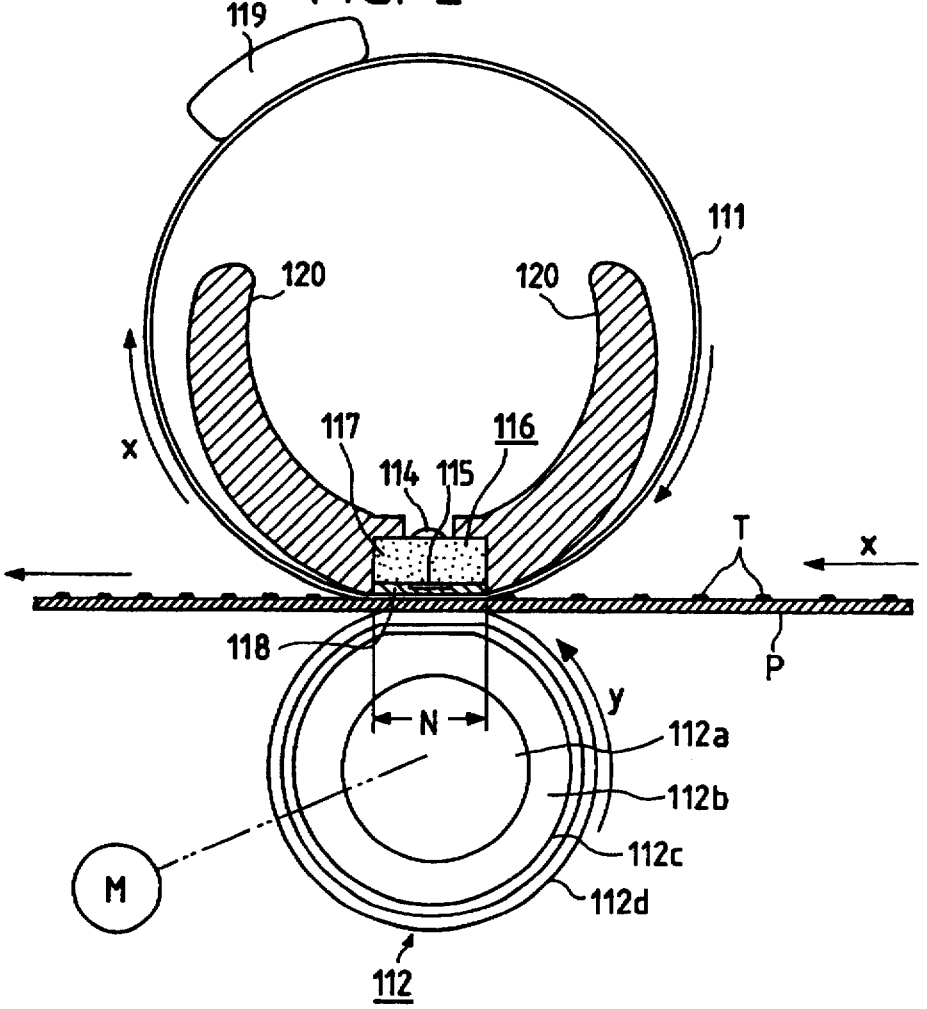
FIG. 2 is a schematic view illustrating an embodiment of the fixing apparatus of the film heating type having the cleaning apparatus of the present invention.

FIG. 2 is a schematic view of an apparatus (image heat fixing apparatus) of the film heat fixing type having the cleaning apparatus of the present invention.

In FIG. 2, 116 is a heating member (ceramic heater) fixedly supported by a support not shown. A heat-resistant film (fixing film) 111 is brought into close contact with this heating member 116 by means of a pressurizing roller 112 acting as a pressurizing rotating member, and the film is slidingly-conveyed while guiding with guides 120,120. With this heat-resistant film 111 in between, the heating member 116 and the pressurizing roller 112 as the pressurizing member form a pressure-contact nip portion (fixing nip portion) N. The recording medium P on which the image is to be fixed, as a medium to be heated, is introduced between the heat-resistant film 111 and the pressurizing roller 112 of this pressure-contact nip portion N while guiding the medium with the guide 120. The heat-resistant film 111 and the recording medium P are placed in the pressure-contact nip portion N, and the film 111 is conveyed in the arrow x direction. Heat of the heating member 116 is thus imparted to the recording medium P through the heat-resistant film 111. Then, the unfixed toner image T carried on the recording medium P is heat-fixed onto the recording medium P surface. That is, the unfixed toner image carried on the recording medium P is fixed thereon by the fixing film 111 serving as the heat fixing member which comes into contact with the toner image under pressure. The recording medium P having passed through the pressure-contact nip portion N is separated from the surface of the film 111 and conveyed.

The heating member 116 is a linear heating member having a low heat capacity as a whole, which comprises a long heat-resistant, insulating and highly conductive substrate 117 of which the longitudinal direction is at right angles to the conveying direction x of the heat-resistant film 111 or the recording medium P as the heated medium; a resistance heat generating member 115 formed along the length of the substrate at the width center on the surface side of the substrate; supply electrodes 120 serving as guides provided on the both sides of the resistance heat generating member 115; a heat-resistant overcoat layer 118 which regulates the resistance heat generating member and protects the heating member surface; and a temperature detecting device 114, provided on the back side of the substrate, for detecting temperature of the heating member, such as a thermistor.

This heating member 116 is fixed arranged by adhering and connecting onto a rigid and heat-insulating heater support by downwardly exposing the surface side provided with the resistance heat generating member 115 formed thereon.

The heating member 116 is heated by heat generation of the resistance heat generating member 115 over the entire length thereof as a result of power supply to the electrodes 120 at the both ends of the resistance heat generating member 115. This temperature increase is detected by the temperature detecting device 114. The detected temperature is fed back to a temperature control circuit (not shown), so that power supply to the resistance heat generating member 115 is controlled so as to maintain the temperature of the heating member at a prescribed level. Upon fixing, power supply to the resistance heat generating member 115 is controlled so that the detection output of this temperature detecting device (thermistor) 114 is kept constant. For the heating member, a heating apparatus based on alternate magnetism injection may be used in place of the ceramic heater.

The heat-resistant film 111 is of a configuration in which an endless belt is rotated for transportation under the effect of frictional force between a driving roller and the inner surface of the film, the driving roller being one of rollers stretching the belt; a configuration in which the film is transported by the frictional force between a driving roller and the film outer surface, the driving roller being the pressurizing roller 112 or any other driving roller in contact with the outer surface of the film; or a configuration in which the heat-resistant film 111 takes the form of a long film wound on a roller and this is taken out for transportation.

In the same drawing, 119 is the cleaning apparatus of the present invention. This cleaning apparatus comprises a cleaning member coming into contact with the heat-resistant film 111 and the above-mentioned wax b impregnated into this cleaning member. This cleaning member should preferably be the one described as to the felt-like wax pad 106 shown in FIG. 1.

The pressuring roller 112 serving as the pressurizing rotating member is the same as the pressure contact roller 102 of the heat fixing apparatus of the heat roller type of FIG. 1 described above, and is a solid elastic roller (hereinafter referred to as the "solid roller") comprising a metal core **112*a* and a heat-resistant rubber layer 112*b* excellent in releasability such as silicone rubber. The pressurizing roller 112 is arranged in contact with the surface of the heating member 116 with, the film 111 in between, under the effect of a prescribed pressure provided by bearing means or application means not shown. When using this pressurizing roller 112 as the film driving roller, rotational force is transmitted from a driving means not shown to this roller 112** to cause its rotational driving anticlockwise in the arrow y direction.

A preferred embodiment of the heating roller as the heating member in the present invention is an elastic roller comprising a heat-resistant rubber **112*b* layer as the substrate layer, a fluorine resin layer 112*d* serving as the outermost layer, having a specific contact angle with wax b in the cleaning apparatus of the present invention and wax a in the toner, and a fluorine rubber layer 112*c* having a higher hardness than that of the substrate heat-resistant rubber layer 112*b*** and a thickness of from 5 to 10 μm arranged between the substrate layer and the outermost layer.

The fluorine resin of the outermost layer should preferably comprise mainly EFP (tetrafluoroethylene-hexafluoropropylene copolymer).

As the above-mentioned configuration makes the elastic roller excellent in releasability for a long period of time with a satisfactory adhesive force between the layers, it is possible to achieve an excellent durability and keep a low roller hardness.

A preferred embodiment of the heat fixing apparatus of the film heating type in the present invention is a heating apparatus shown in FIG. 2 which uses the above-mentioned elastic roller as the pressurizing rotating member, inserts the heat-resistant film between this pressurizing rotating member and the heating member, introduces the recording medium P as the member to be heated between the heat-resistant film of the pressure-contact nip portion, formed by the heating member and the pressurizing rotating member, and the pressurizing rotating member, and transports the recording medium, together with the heat-resistant film through the nip portion to transmit the heat of the heating member to the member to be heated via the heat-resistant film.

Another preferred embodiment of the heat fixing apparatus of the film heating type is a heating apparatus which comprises a heat-resistant member such as a heat-resistant film or a belt having a conductive layer, a pressurizing member having a conductive layer, and an alternate magnetic field generating means generating eddy current to produce heat by providing a magnetic field to these conductive layers, and heats the recording medium as the medium to be heated by transporting it while holding it in the pressurizing contact nip portion between the heat-resistant member and the pressurizing member.

In a preferred embodiment of the heat-resistant member such as a heat-resistant film or belt serving as the heat fixing member in the present invention, it is preferable to provide an outermost layer comprising fluorine resin composed mainly of FEP and form an elastic layer on the inner side thereof.

Therefore, in the present invention, in any of the heat fixing apparatus of the heating roller type, the heat fixing apparatus of the film heating type and the heat fixing apparatus of any other type, the heat fixing member in pressure-contact with a unfixed toner image carried on the recording medium should preferably satisfy the above-mentioned requirement for a specific contact angle with wax b in the cleaning apparatus or wax a contained in the toner. It is therefore desirable to form the outermost layer of the heating member with a copolymer having at least a repeating unit of tetrafluoroethylene in the main chain. More preferably, it should be formed with FEP, PFA (tetrafluoroethylene-perfluoroalkylvinylether copolymer) having fluoroalkoxy group and/or fluoroalkyl group in the side chain. When taking account of the prevention of toner contamination, it is further more preferable that it is formed with FEP having fluoroalkyl group in the side chain.

The heat fixing method of the present invention has a toner carrying step which carries the toner images formed by a color toner on the recording medium, and a fixing step of fixing the unfixed toner image carried on the recording medium onto the recording medium by means of the heat fixing member in pressure-contact with the toner image. The heat fixing member is cleaned after the fixing step by means of the above-mentioned cleaning apparatus of the present invention.

Further, the image forming method of the present invention comprises an electrostatic latent image forming step of forming an electrostatic latent image on a latent image holding member, a developing step of developing the electrostatic latent image with a toner and forming a toner image, a transferring step of transferring the toner image onto a recording medium, a fixing step of fixing the unfixed toner image carried on the recording medium onto the recording medium by means of a heat fixing member in pressure-contact with the toner image, and a cleaning step of cleaning the heat fixing member by means of a cleaning apparatus. The cleaning apparatus of the present invention is used as this cleaning apparatus.

Now, an embodiment of the image forming method of the present invention is described below in detail with reference to FIG. 3.

Figure 3:
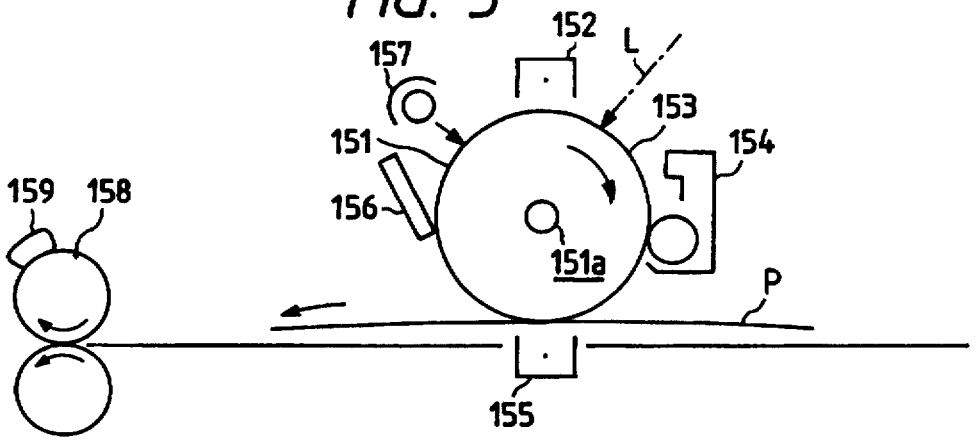
FIG. 3 is a schematic view illustrating an embodiment of an image forming apparatus to which the image forming method of the present invention is applicable.

FIG. 3 is a schematic configuration diagram illustrating an embodiment of the image forming apparatus to which the image forming method of the present invention is applicable.

In FIG. 3, 151 is a drum-shaped photosensitive member serving as a latent image carrier, and rotation-driven around an axis 151*a* in the arrow direction at a prescribed circumferential speed. The photosensitive member 151 receives uniform charging with a prescribed positive or negative potential on the circumferential surface thereof from charging means 152 during rotation thereof, and then, in the exposure section 153, receives light image exposure L (slit exposure, laser beam scanning exposure, etc.). Thus, electrostatic latent images corresponding to exposed images are sequentially formed on the surface of the photosensitive member.

Then, a toner image is formed from the electrostatic latent image through development by a developing means 154, and the toner images are sequentially transferred onto the surface of recording medium P fed in synchronization with rotation of the photosensitive member 151 between the photosensitive member 151 and a transfer means 155 from a paper feed not shown by means of the transfer means 155.

The recording medium P onto which the toner, image has been transferred is separated from the surface of the photosensitive member, introduced into fixing means 158, receives fixing of the toner image, and then printed out as a copy.

The fixing means 158 is provided with a cleaning apparatus (wax pad 159) for cleaning the heat fixing member for example as shown in FIG. 2 of the present invention.

After transfer of the toner image, residual toner remaining after transfer is removed from the surface of the photosensitive member 151 by cleaning means 156 into a cleaned surface, and further, after electricity eliminating treatment by a pre-exposure means 157, it is separately used for repetitive image forming.

A corona charging apparatus is commonly used as the uniform charging means 152 of the photosensitive member 151. Corona transfer means is popularly used as the transfer apparatus 151.

When the electrophotographic apparatus is used as a copying machine or a printer, light image exposure L is accomplished, by converting an original or reflection light or transmission light into a read signal, and through scanning of laser beam, driving of LED array, or driving of liquid crystal shutter array with this signal.

Figure 7:
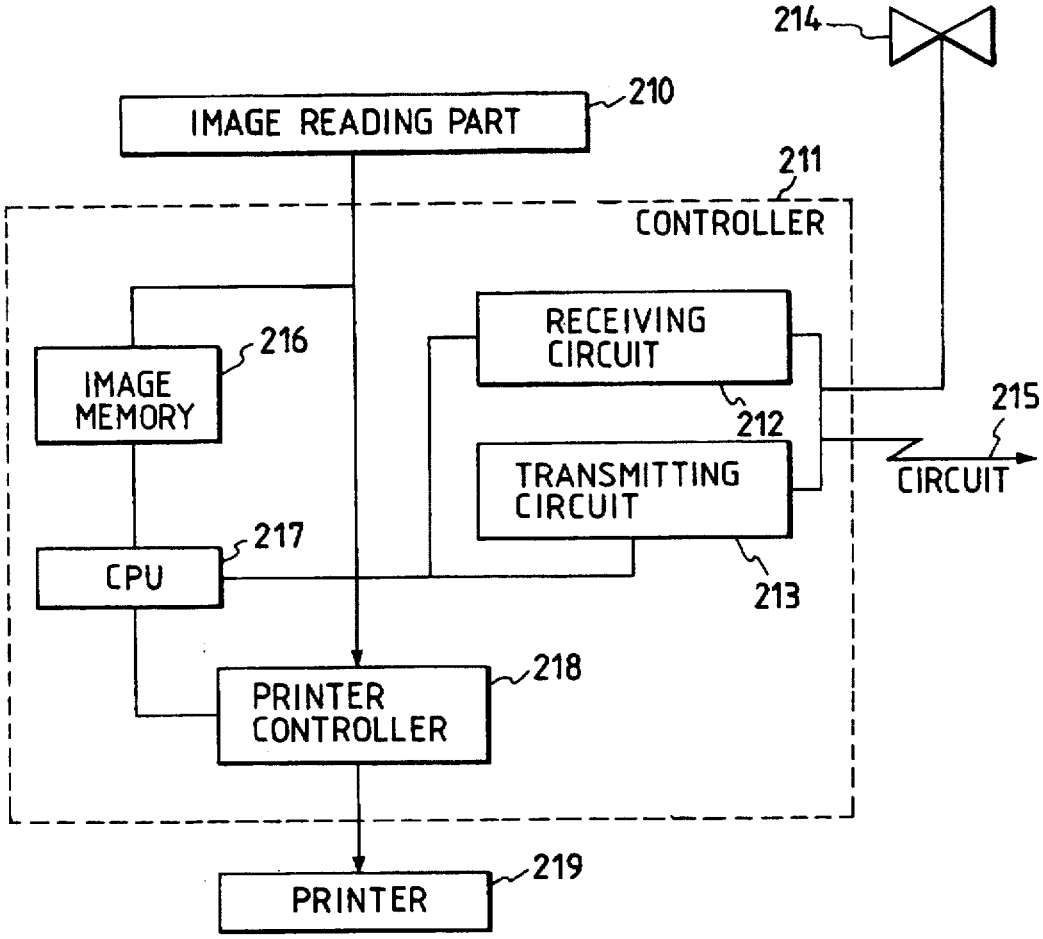
FIG. 7 is a block diagram illustrating a case where the image forming apparatus of the present invention is applied to the printer of a facsimile machine.

When using the image forming apparatus of the present invention as a printer for a facsimile machine, light image exposure L becomes exposure for printing received data. FIG. 7 shows an example of such a case in the form of a block diagram.

A controller 211 controls an image reading section 210 and a printer 219. The entire controller 211 is controlled by a CPU 217. Read data from the image reading section is transmitted through a transmission circuit 213 to the other party. Data received from the other party is sent through a receiving circuit 212 to the printer 219. Prescribed image data is stored in an image memory. A printer controller 218 controls the printer 219. In FIG. 7, 214 is a telephone set.

Images received from a line 215 (image information from remote terminals connected via lines) are demodulated at a receiving circuit 212, and then, the CPU 217 conducts decoding of the image information. Images are then stored sequentially in the image memory 216. Upon storage of images at least for a page into the memory 216, image recording for that page is performed. The CPU 217 reads out image information for a page from the memory 216, and sends composite 1-page image information to a printer controller 218. Upon receipt of 1-page image information, the printer controller 218 controls the printer 219 so as to conduct image information recording for that page.

The CPU 217 performs receiving of the next page during recording by the printer 219.

Receiving and recording of image is accomplished as described above.

Figure 4:
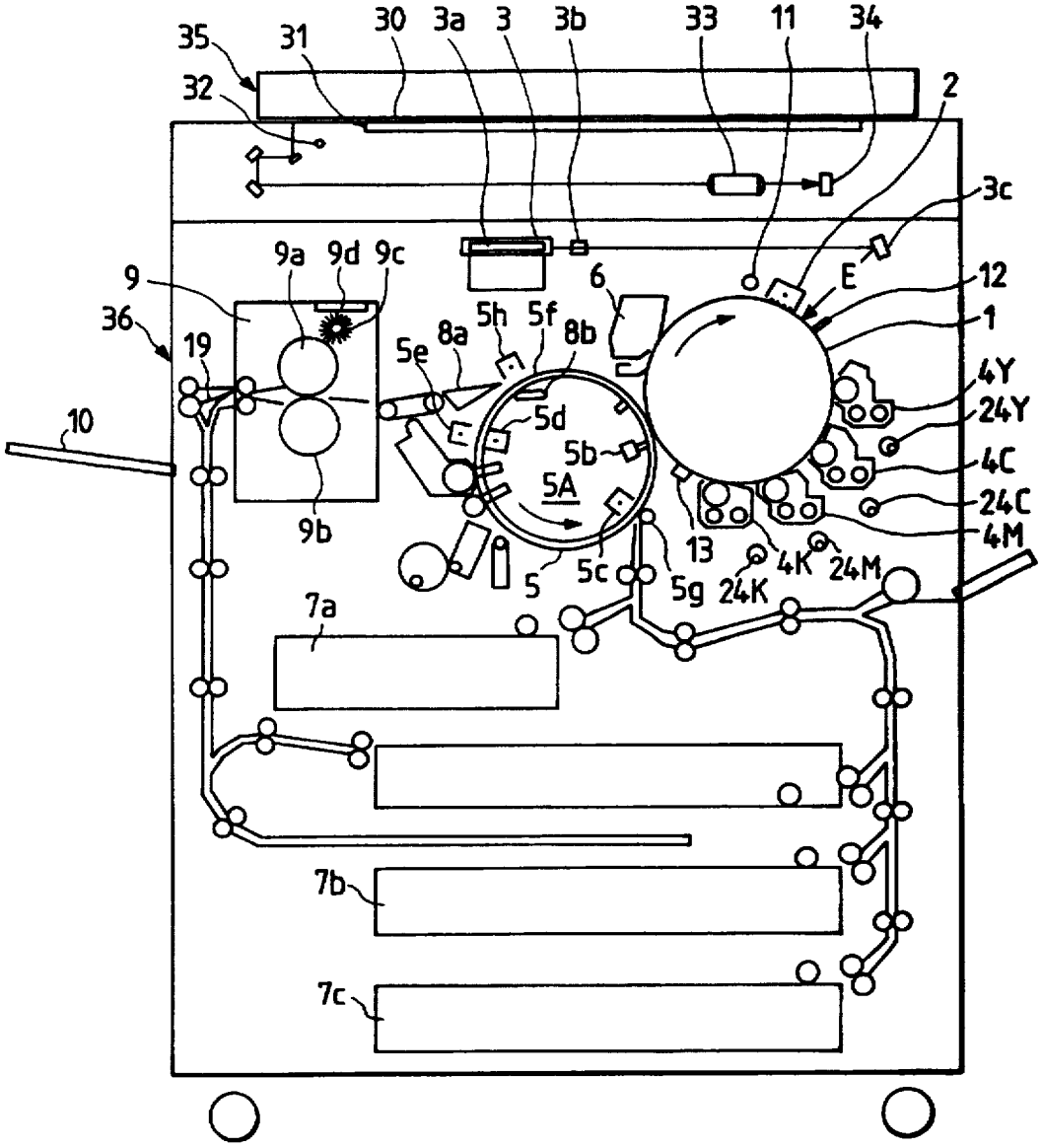
FIG. 4 is a schematic view illustrating an embodiment of an image forming apparatus to which the image forming method of the present invention is applicable, and which permits forming of a full-color image.

FIG. 4 is a schematic view illustrating an embodiment of the image forming apparatus capable of forming a full-color image in which the image forming method of the present invention is applicable.

This image forming apparatus is formed into a full-color copying machine. The full-color copying machine comprises, as shown in FIG. 4, a digital color image reader section 35 at the top, and a digital color image printer section 36 at the bottom.

In the image reader section, an original 30 is placed on an original stand glass 31. Through exposure-scanning by means of an exposure lamp 32, reflected light image from the original 30 is condensed through a lens 33 onto a full-color sensor 34 to obtain a color resolving image signal. The color resolving image signal is processed via an amplifier circuit (not shown) in a video processing unit (not shown), and sent to a digital image printer section.

In the image printer section, a photosensitive drum 1 which is a latent image holding member, is a photosensitive member like, for example, an organic optical conductor, and carried rotatably in the arrow direction. Around the photosensitive drum 1, there are arranged a pre-exposure lamp 11, a corona charger 2 as a primary charging member, a laser exposure optical system 3 as latent image forming means, a potential sensor 12, four different-color developing units 4Y, 4C, 4M and 4K, light quantity detecting means 13 on the drum, a transfer apparatus 5A and a cleaning apparatus 6.

In the laser exposure optical system 3, an image signal from the reader section is converted into a light signal for image scanning exposure in a laser output section (not shown). The converted laser beam is reflected on a polygonal mirror 3*a*, and projected through the lens 3*b* and mirror 3*c* onto the surface of the photosensitive drum 1.

The printer section rotates the photosensitive drum 1 in the arrow direction upon forming an image, and after elimination of electricity by the pre-exposure lamp 11, negatively charges uniformly the photosensitive drum 1 by means of the charger 2 to irradiate a light image E for each resolved color and to form a latent image on the photosensitive drum 1.

Then, the latent image on the photosensitive drum 1 is developed by operating a prescribed developing unit, to form a visible image of negative toner based on resin, i.e., a toner image on the photosensitive drum 1. Each of the developing units 4Y, 4C, 4M and 4K selectively approaches the photosensitive drum 1, depending upon respective resolved colors, by the action of respective eccentric cams 24Y, 24C, 24M and 24K, to perform development.

The transfer apparatus SA comprises a transfer drum 5, a transfer charger 5*b*, an adsorption charger 5*c* for electrostatically adsorbing the recording medium and an adsorbing roller 5*g* opposing thereto, an inner charger 5*d*, an outer charger 5*e*, and a separating charger 5*h*. The transfer drum 5 is rotation-drivably supported, and a transfer sheet 5*f* which is a recording medium carrier carrying the recording medium in the opening area therearound is integrally adjusted in a cylindrical shape. A polycarbonate film is for example used as the transfer sheet 5*f*.

The recording medium is sent from recording medium cassette 7*a*, 7*b* or 7*c* through a recording medium transporting system to the transfer drum 5, and carried on the transfer sheet 5*f* thereof. The recording medium carried on the transfer drum 5 is repeatedly transported to the transfer position opposite to the photosensitive drum 1 along with rotation of the transfer drum 5, and the toner image on the photosensitive drum 1 is transferred onto the recording medium under the action of the transfer charger 5*b* during the course of passing through the transfer position.

The above-mentioned image forming steps are repeated for each of yellow (Y), magenta (M), cyan (C) and black (K), and thus, a color image onto which four-color toner images have been transferred one upon the other on the recording medium on the transfer drum is obtained.

When forming an image only on one side, the recording medium onto which the four-color toner images have been transferred as described above is separated from the transfer drum 5 under the action of a separating claw 8*a*, separating and push-up roll 8*b* and a separation charger 5*h*, and sent to the heat fixing apparatus 9. This heat fixing apparatus 9 has a fixing apparatus comprising a heat fixing roller 9*a* serving as the heat fixing member having an internal heating means and a pressurizing roller 9*b*. It also has a cleaning apparatus which comprises a cleaning roller 9*c* formed by planting brush-like fibers into a cylindrical shape as a cleaning member, and a wax pad 9*d* impregnated with wax.

This cleaning roller 9*c* as the cleaning member and the wax pad 9*d* have the same constructions as those shown in FIG. 1. The heat fixing apparatus 9 of the image forming apparatus shown in FIG. 4 has therefore the cleaning apparatus of the present invention, and the surface of the heat fixing roller 9*a* is cleaned.

Through passage of the recording medium through the pressure-contact portion between the heat fixing roller 9*a* as the heat fixing member and the pressurizing roller 9*b*, the full-color image carried on the recording medium is fixed onto the recording medium. More specifically, color mixing, color development and fixation onto the recording medium are accomplished through this fixing step, and after establishment of a full-color permanent image, the medium is discharged into a tray 10, thus completing the entire steps of full-color copying for one sheet. The photosensitive drum 1 is, on the other hand, subjected to the image forming steps again after elimination of residual toner from the surface by means of the cleaning apparatus 6.

In the image forming method of the present invention, it is possible to transfer a toner image available after development of an electrostatic latent image onto the recording medium via an intermediate transfer member.

More specifically, this image forming method comprises the steps of a first transfer step of transferring a toner image formed by developing an electrostatic latent image formed on the latent image holding member onto the intermediate transfer member, and a second transfer step of transferring the toner image transferred onto the intermediate transfer member onto the recording medium.

An embodiment of the image forming method using the intermediate transfer member is described in detail below with reference to FIG. 5.

Figure 5:
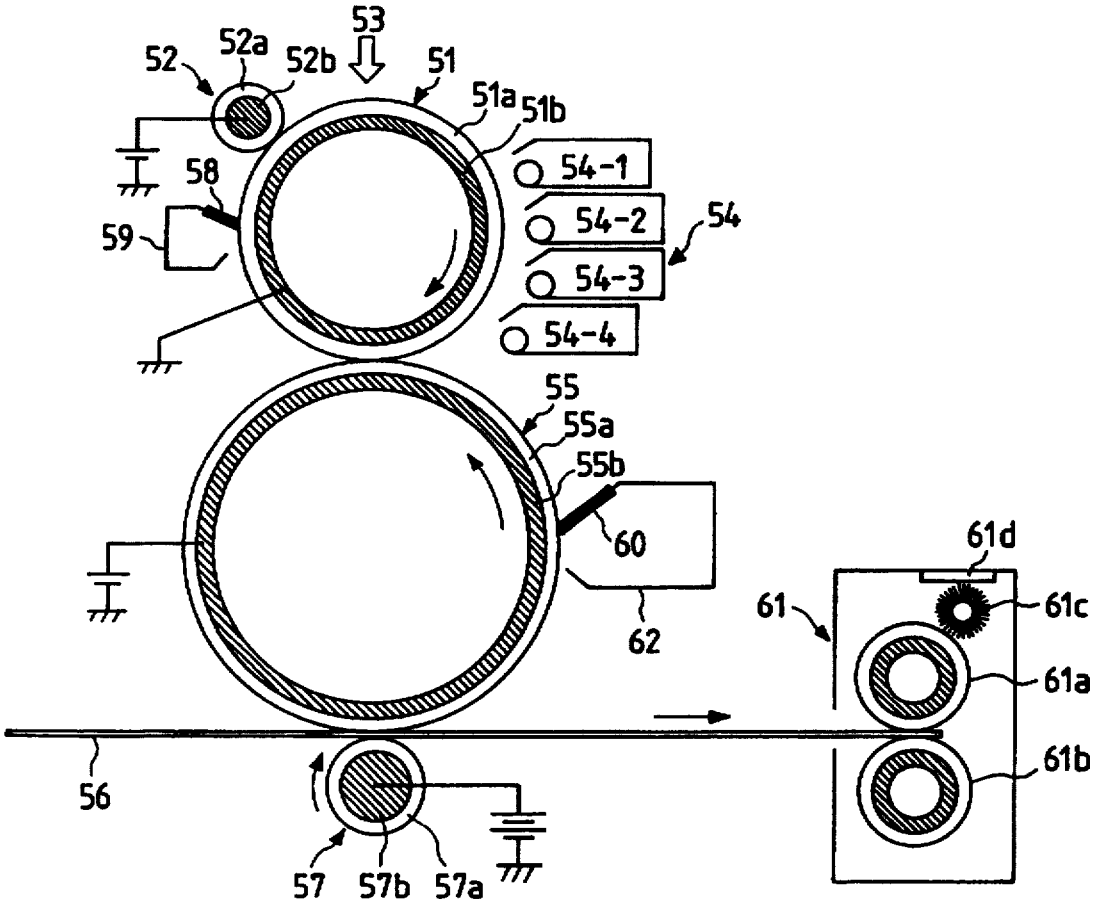
FIG. 5 is a schematic view illustrating an embodiment of an image forming apparatus using an intermediate transfer member used in the image forming method of the present invention.

In the equipment system shown in FIG. 5, developing unit 54 comprises a cyan developing unit 54-1, a magenta developing unit 54-2, a yellow developing unit 54-3 and a black developing unit 54-4 are filled with a cyan developing agent having a cyan toner, a magenta developing agent having a magenta toner, a yellow developing agent having a yellow toner and a black developing agent having a black toner, respectively. An electrostatic latent image is formed on the photosensitive member 51 serving as the latent image holding member by means of latent image forming means 53 such as laser beam. The electrostatic image formed on the photosensitive member 51 is developed with the use of these developing agents by the application of any of such developing processes as the magnetic brush developing process, the non-magnetic one-component developing process and the magnetic jumping developing process, and a toner image for each color is formed on the photosensitive member 51. The photosensitive member 51 is a photosensitive drum or a photosensitive belt having a conductive substrate 51*b* and a photoconductive insulating layer 51*a* composed of, for example, amorphous selenium, cadmium sulfide, zinc oxide, an organic photoconductor, and amorphous silicon formed on the conductive substrate 51*b*. The photosensitive member 51 is rotated in the arrow direction by a driving apparatus not shown. A photosensitive member having an amorphous silicon photosensitive layer or an organic photosensitive layer is favorably used as the photosensitive member 51.

The organic photosensitive layer may be of the monolayer type containing a charge generating substance and a substance having a charge transporting function simultaneously in a single layer, or of the functional separating type composed of a charge transport layer and a charge generation layer. The lamination type photosensitive layer comprising a charge generation layer on a conductive substrate, and then a charge transport layer formed thereon is a preferred example.

Among applicable binder resins for the organic photosensitive layer, polycarbonate resin, polyester resin and acryl resins show a satisfactory cleaning property, preventing occurrence of defective cleaning, fusion adherence of toner to the photosensitive member, or filming.

In the present invention, the photosensitive member 51 using the corona charger in the charging step may be of the noncontact type or of the contact type using a contact charging member such as a roller. For ensuring effective and uniform charging, simplification and inhibition of the generation of ozone, the one of the contact type as shown in FIG. 5 is favorably applicable The charging roller 52 serving as the primary charging member has a basic construction composed of a core **52*b* at the center and a conductive elastic layer 52*a* forming the outer periphery. The charging roller 52 is brought into pressure contact by a pushing force onto the surface of the photosensitive member 51, and rotates along with rotation of the photosensitive member 51**.

Preferable process conditions when using the charging roller include a roller contact pressure within a range of from 5 to 500 g/cm, and when using overlapping DC and AC voltage, an AC voltage of from 0.5 to 5 kVpp, an AC frequency of from 50 to 5 kHz, and a DC voltage of from ±0.2 to ±5 kV.

Other applicable contact charging members include a type using a charging blade and one using a conductive brush. These contact charging members have such effects as elimination of the necessity of a high voltage and reduction of generation of ozone.

The material for the charging roller and the charging blade serving as the contact charging members should preferably be a conductive rubber, and a releasing film may be provided on the surface thereof. Applicable releasing films include nylon-based resins, PVDF (polyvinylidene fluoride), PVDC (polyvinylidene chloride), and fluorine containing acrylic resins.

The toner image on the photosensitive member is transferred onto the intermediate transfer member 55 applied with voltage (for example, ±0.1 to ±5 kV). The intermediate transfer member 55 comprises a pipe-shaped conductive core **55*b* and an elastic layer 55*a* of a medium resistance forming the outer periphery thereof. The core 55*b*** may be a plastic piece having a conductive layer (a conductive plating, for example) on the surface thereof.

The elastic layer **55*a*** of medium resistance is a solid or foamed layer comprising an elastic material such as silicone rubber, Teflon rubber, chloroprene rubber, urethane rubber, or EPDM (ethylene-propylene-dien terpolymer), blended and dispersed with a conductive additive such as carbon black, zinc oxide, tin oxide or silicon carbide to adjust electric resistance (volume resistivity) to a medium level within a range of from $10^5$ to $10^{11}$ Ωcm.

The intermediate transfer member 55 is bearing-supported in parallel with the photosensitive member 51, and arranged in contact with the bottom surface of the photosensitive member 51. It rotates anticlockwise in the arrow direction at the same circumferential speed as the photosensitive member 51.

During the course in which the toner image of the first color formed and carried on the surface of the photosensitive member 51 passes through the transfer nip section at which the photosensitive member 51 and the intermediate transfer member 55 are brought into contact with each other, the image is sequentially transferred onto the outer surface of the intermediate transfer member 55 under the effect of electric field formed in the transfer nip section by the transfer bias applied to the intermediate transfer member 55.

Transfer residual toner remaining on the photosensitive member 51, which has not been transferred to the intermediate transfer member 55 is cleaned by the cleaning member 58 for the photosensitive member and collected into a cleaning container 59 to the photosensitive member.

Transfer means is arranged, in contact with the bottom surface of the intermediate transfer member 55, bearing-supported in parallel with the intermediate transfer member 55. The transfer means is, for example, the transfer roller 57, and rotates clockwise in the arrow direction at the same circumferential speed as the intermediate transfer member 55. The transfer roller 57 may be arranged so as to be in direct contact with the intermediate transfer member 55, or may be arranged so that a belt or the like is in contact between the intermediate transfer member 55 and the transfer roller 57.

The transfer roller 57 is basically composed of a core **57*b* at the center and a conductive elastic layer 57*a*** forming the outer periphery thereof.

As the intermediate transfer member and the transfer member used in the present invention, usual materials may be used. In the present invention, it is possible to alleviate voltage applied to the transfer member by setting a volume inherent resistivity value for the transfer member smaller than that for the intermediate transfer member. This permits also formation of a satisfactory toner image on the transfer member and prevention of entanglement of the transfer member into the intermediate transfer member. The volume inherent resistivity value for the elastic layer of the intermediate transfer member should preferably be more than ten times as high as that of the elastic layer of the transfer member.

Hardness of the intermediate transfer member and the transfer member is measured in compliance with JIS K-6301. The intermediate transfer member used in the present invention should preferably be composed of an elastic layer falling under a range of from 10° to 40°. Hardness of the elastic layer of the transfer member used in the present invention should preferably be higher than hardness of the elastic layer of the intermediate transfer member. A hardness within a range of from 41° to 80° is particularly preferable because of the prevention of entanglement of the recording medium into the intermediate transfer member. If hardness of the elastic layer of the transfer member is lower than that of the elastic layer of the intermediate transfer member, a dent may be formed on the transfer member side, and this easily causes entanglement of the recording medium into the intermediate transfer member.

As the transfer member, for example, a transfer roller is employed. The transfer roller 57 is rotated at the same or different circumferential speed as compared with that of the intermediate transfer member 55. The recording medium 56 is transferred between the intermediate transfer member 55 and the transfer roller 57, and at the same time, the toner image on the intermediate transfer member 55 is transferred onto the surface side of the recording medium 56 by applying bias of the polarity opposite to that of the triboelectric charge of the toner to the transfer roller 57, from transfer bias means.

Residual toner remaining on the intermediate transfer member, not transferred onto the recording medium 56, is cleaned off by a cleaning member 60 for the intermediate transfer member and collected into a cleaning container 62 for the intermediate transfer member. The toner image transferred onto the recording medium 56 is fixed on the recording medium 56 by the heat fixing apparatus 61.

The heat fixing apparatus 61 has a fixing apparatus comprising a heat fixing roller 61*a* serving as the heat fixing member and a pressurizing roller 61*b*, and a cleaning apparatus comprising a cleaning roller 61*c* formed by planting brush-like fibers as the cleaning members into a cylindrical shape, and a wax pad 61*d* impregnated with wax.

The cleaning roller 61*c* as the cleaning member and the wax pad 61*d* have the same constructions as those shown in FIG. 1. Therefore, the heat fixing apparatus 61 shown in FIG. 5 has the cleaning apparatus of the present invention, and the surface of the heat fixing roller 61*a* is cleaned.

Applicable materials for the transfer roller are the same as those of the charging roller. Preferred transfer process conditions include a pressure-contact pressure of the roller within a range of from 2.94 to 490 N/m (3 to 500 g/cm) (more preferably, from 19.6 N/m to 294 N/m) and DC voltage within a range of from ±0.2 to ±10 kV.

A linear pressure as the contact pressure of less than 2.94 N/m tends to cause transportation shift of the recording medium or defective transfer.

The conductive elastic layer 57*b* of the transfer roller 57 is a solid or foamed layer in which a conductive additive such as carbon black, zinc oxide, tin oxide, or silicon carbide is blended and dispersed in an elastic material such as polyurethane rubber, or EPDM (ethylene-propylene-dien terpolymer) to adjust the electric resistance value (volume resistivity) to a medium resistance within a range of from $10^6$ to $10^{10}$ Ωcm.

In the present invention, as the cleaning apparatus in contact with the heat fixing member in the cleaning apparatus for cleaning the surface of the heat fixing member is impregnated with wax b, it is excellent in sweepability or wiping property on the surface of the heat fixing member, free from sticky feeling of the transparency film as the first recording medium upon restarting after a long suspension of image forming, and it is possible to ensure fixing excellent in offset resistance for a long period of time (running of copying on a great number of sheets).

The arrangement of the present invention will be described below with reference to examples. The present invention, however, is not limited to these examples.

EXAMPLE 1

Four hundred fifty grams of 0.1 M-$Na_3PO_4$ aqueous solution were added to 710 g ion exchange water, and the mixture was heated to 60° C. and then stirred at 13,000 rpm with a TK-type homomixer (available from Tokushu Kika Kogyo). Sixty-eight grams of 1.0 M-$CaCl_2$ aqueous solution were gradually added to this mixture to give an aqueous medium containing $Ca_3(PO_4)_2$.

| | |
|---|---|
| Styrene | 166 g |
| n-butyl acrylate | 34 g |
| Copper (II) phthalocyanine pigment | 15 g |
| Di-t-butyl salicylate metal compound | 3 g |
| Saturated polyester (acid value: 11, peak molecular weight: 8,500) | 10 g |
| Monoester wax 1 | 40 g |

(Mw: 500, Mn: 400, Mw/Mn: 1.25, melting point: 70° C., viscosity: 6.5 mPa·s, Vickers hardness: 1.1, and SP value: 8.6)

The above formula was heated to 60° C. and uniformly dissolved and dispersed at 12,000 rpm with a TK-type homomixer (available from Tokushu Kika Kogyo). Ten grams of 2,2'-azobis (2,4-dimethyl valeronitrile) as a polymerization initiator was dissolved in the resultant solution to prepare a polymerizable monomer composition. The polymerizable monomer composition put in the aqueous medium and stirred at 10,000 rpm with a TK-type homomixer for 20 minutes in a nitrogen atmosphere at 60° C. to granulate the polymerizable monomer composition. Thereafter, the solution was heated to 80° C. while being stirred with paddle stirring blades, and the polymerization reaction was carried out for 10 hours.

Upon completion of the polymerization reaction, the reaction mixture was cooled and hydrochloride acid was added to dissolve calcium phosphate. Then the reaction was filtrated and washed with water, and dried to give polymer particles (toner particles).

The binding resin of the polymer particles had an SP value of 19 and Tg of 60° C.

To 100 parts by weight of the obtained polymer particles (toner particles), 2.0 parts by weight of hydrophobic titanium oxide having a BET specific surface area of 100 $m^2/g$ was externally added to give a cyan toner of an average particle size of 6.2 μm.

To 7 parts by weight of the cyan toner, 93 parts by weight of ferrite carrier of 35 μm which was coated with silicone was mixed to give two-component developer No. 1.

This two-component developer was used in a modified full-color copying machine CLC-800 (Canon). The image forming apparatus had been modified to remove the oil applying mechanism (FIG. 1) as follows: a heating roller and pressure roller (a heat fixing member) both have a surface layer coated with 10-μm EHP; a rotating cleaning roller on which brush-like fibers are cylindrically planted touches a wax pad to receive the wax from the pad and then touches the heating roller to clean it, the wax pad (10 mm×310 mm×1.5 mm) was cut from a nonwoven fabric made of an aromatic polyamide resin and a polyethylene terephthalate resin (available from Nihon Bylean) impregnated at 60° C. for saturation with the same monoester wax as used in the toner. In this case, wax a and wax b are the same and contact angles A (100° C.) and B (200° C.) between the heating roller and the wax a were:

$$A=69°,\ B=74°,\ B-A=5°$$

and contact angles C (100° C.) and D (200° C.) between the heating roller and wax b were:

$$C=69°,\ D=74°,\ D-C=5°$$

An image forming test on 200,000 sheets was performed using two types of originals having image areas of 20% and 50%, and evaluation was performed on the basis of the following evaluation method.

Evaluation Method (1) OHP light transmittance

OHP light transmittance was measured using Shimadzu self-recording spectrophotometer UV2200 (Shimadzu Corp.). The light transmittance of an OHP film itself was set to be 100% and OHP image light transmittance was measured for a magenta toner (650 nm), a yellow toner (500 nm), and a cyan toner (600 nm) respectively with the toner weight per unit area of 1.0 $mg/cm^2$.

A: 60% or more

B: 55% or more and smaller than 60%

C: 50% or more and smaller than 55%

D: smaller than 50%

(2) Uneven Glossiness

Uneven glossiness of an image was evaluated by the difference between the maximum value and the minimum value of glossiness of an A4 solid image fixed on a sheet of CLC-SK paper (available from Canon Inc.) with a toner weight per unit area of 1.0 mg/cm$^2$.

The glossiness was measured using a handy glossimeter gloss checker IG-310 (incident angle of 60°: Horiba, Ltd.)

A: smaller than 3

B: over 3 to 6 or less

C: over 6 to 10 or less

D: over 10

(3) Offset Resistance

A continuous image forming test was performed on 200,000 sheets, and evaluation was performed based on the following evaluation criterions:

A: Stain was not detected on the front and back of sheets of recording paper up to 200,000 sheets during the continuous running test.

B: Slight stain was detected on the back of the sheets by 200,000 sheets running.

C: Stain was not detected on the back of the sheets by 50,000 sheets running.

D: Stain was detected on the back of the sheets by 50,000 sheets running.

(4) Cleaning Property

Evaluation of the cleaning property was performed as follows. An original having an image area of 50% was copied and the image was fixed at a ¼ speed of the speed usually used for fixing on plain paper, and then a blank sheet of plain paper was passed at an ordinary fixing speed. The Macbeth density of the blank sheet after passing was determined based on the following evaluation criterions.

The macbeth density is an average reflection density of 10 measurement points measured using Macbeth Densitometer RD918 (available from Macbeth) using a filter.

(Evaluation Criterions)

A: 0.1 or less

B: over 0.1 to 0.2 or less

C: over 0.2 to 0.5 or less

D: over 0.5

(5) Stickiness of OHP Sheet

A mixture of a toner and a carrier (two-component developing agent for CLC-700) is sprinkled on a transparent sheet on which a blank image (a white solid image) was formed, and the amount of the developer attached to the sheet is visually estimated.

(Evaluation Criterions)

A: Adhesion was hardly observed.

B: Adhesion was partially observed.

C: The developing agent was adhered to the entire area of the sheet.

Evaluation results are shown in Table 2.

Comparative Example 1

Two-components developing agent No. 2 was prepared in the same manner as in Example 1 except that paraffin wax 2 (Mw: 570, Mn: 380, Mw/Mn: 1.50, melting point: 69° C., viscosity: 6.8 Pa·s, Vickers hardness: 0.7, and SP value: 8.3) was used in place of monoester wax 1 for the toner, and evaluation was performed in the same manner as in Example 1 except that the image forming apparatus has, instead of the wax pad, an oil pad (10 mm wide, 310 mm long, and of 1.5 mm thick) made of a nonwoven fabric (available from Nihon Bylean) containing an aromatic polyamide resin and a polyethylene terephthalate resin impregnated for saturation at 120° C. with a silicone oil having a viscosity of 300 centistokes at 25° C. In this case, contact angles A and B between the heating roller and the wax a were as follows:

$A$=83°, $B$=92°, $B$–$A$=9°

Evaluation results are shown in Table 2.

Comparative Example 2

An evaluation was performed in the same manner as in Example 1 except that PTFE was used in place of FEP for the surface material of the heating roller serving as a heat fixing member, and that the image forming apparatus has, instead of the wax pad, an oil pad (10 mm wide, 310 mm long, and of 1.5 mm thick) made of a nonwoven fabric (available from Nihon Bylean) containing an aromatic polyamide resin and a polyethylene terephthalate resin impregnated for saturation at 120° C. with a silicone oil having a viscosity of 300 centistokes at 25° C.

Evaluation results are shown in Table 2.

Comparative Example 3

An evaluation was performed in the same manner as in Example 1 except that RTV silicone rubber was used in place of FEP for the surface material of the heating roller serving as a heat fixing member, and that the image forming apparatus has, instead of the wax pad, an oil pad (10 mm wide, 310 mm long, and of 1.5 mm thick) made of a nonwoven fabric (available from Nihon Bylean) containing an aromatic polyamide resin and a polyethylene terephthalate resin impregnated for saturation at 120° C. with a silicone oil having a viscosity of 300 centistokes at 25° C.

Evaluation results are shown in Table 2.

EXAMPLE 2

Images were reproduced in the same manner as in Example 1 except that PFA was used in place of FEP used for the surface material of the heating roller serving as a heat fixing member, and that the image forming apparatus has a wax pad (10 mm wide, 310 mm long, and of 1.5 mm thick) made of a continuous-forming silicone rubber having an ASKER C type rubber hardness of 30° impregnated for saturation at 60° C. with the monoester wax 1. Good results were obtained as shown in Table 1.

EXAMPLE 3

Two-component developing agent No. 3 was prepared in the same manner as in Example 1 except that diester wax 3 (Mw: 480, Mn: 410, Mw/Mn: 1.17, melting point: 73° C., viscosity: 10.5 mPa·s, Vickers hardness: 1.0, and SP value: 9.1) was used in place of monoester wax 1, and evaluation was performed in the same manner as in Example 1 except that the diester wax 3 was used for the wax pad in place of monoester wax 1. Good results were obtained as shown in Table 2.

EXAMPLE 4

Two-component developing agent No. 4 was prepared in the same manner as in Example 1 except that tetraester wax 4 (Mw: 430, Mn: 380, Mw/Mn: 1.34, with a shoulder at molecular weight of 850, melting point: 73° C., viscosity: 11.6 mPa·s, Vickers hardness: 1.2, and SP value: 8.5) was used in place of monoester wax 1 used in Example 1, and evaluation was performed using a wax pad impregnated with the diester wax 4 in place of monoester wax 1. Good results were obtained as shown in Table 2.

EXAMPLE 5

An evaluation was performed in the same manner as in Example 1 except that tetraester wax 5 (Mw: 525, Mn: 350, Mw/Mn: 1.5, with a shoulder at Mw 900, viscosity: 10.9 mPa·s, Vickers hardness: 1, and SP value: 9) was used in place of monoester wax 1 for the wax pad. As a result, the developing agent of Example 5 were practically usable although OHP light transmittance, sticky feeling of OHP sheets, and uneven glossiness of the images were ranked at B in comparison with those of Example 1.

The physical properties of two-components developing agents Nos. 1 to 4 used in Examples 1 to 5 and Comparative Examples 1 to 3 are shown in Table 1, and the evaluation results of Examples 1 to 5 and Comparative Examples 1 to 3 are shown in Table 2.

TABLE 1

| | Wax | | | | | | | Binding Resin | |
|---|---|---|---|---|---|---|---|---|---|
| | Mw | Mn | Mw/Mn | Melting Point (°C.) | Melting Viscosity mPa · s | Vickers Hardness | SP Value | SP Value | Tg (°C.) |
| Developing Agent No. 1 | 500 | 400 | 1.25 | 70° | 6.5 | 1.1 | 8.6 | 19 | 60 |
| Developing Agent No. 2 | 570 | 380 | 1.50 | 69° | 6.8 | 0.7 | 8.3 | 19 | 60 |
| Developing Agent No. 3 | 480 | 410 | 1.17 | 73° | 10.5 | 1.0 | 8.5 | 19 | 60 |
| Developing Agent No. 4 | 430 | 320 | 1.34 | 73° | 11.6 | 1.2 | 8.5 | 19 | 60 |

TABLE 2

| | Developing Agent | Surface Layer Material of Heat Fixing | Contact Angle (°) | | | Releasing Agent Held by Cleaning Member | Contact Angle (°) | | | OHP light transmittance | Image Uneven Glossiness | Offset Resistance | | Cleaning Property | Feeling of Stickiness |
|---|---|---|---|---|---|---|---|---|---|---|---|---|---|---|---|
| | No. | Member | A | B | B − A | | C | D | D − C | | | 20% | 50% | | OHP Sheet |
| Example 1 | No. 1 | FEP | 69 | 74 | 5 | Monoester wax 1 | 69 | 74 | 5 | A | A | A | A | A | A |
| Comparative Example 1 | No. 2 | FEP | 83 | 92 | 9 | Silicone oil | — | — | — | C | C | A | A | D | B |
| Comparative Example 2 | No. 1 | PTFE | 83 | 84 | 1 | Silicone oil | — | — | — | A | C | A | C | D | C |
| Comparative Example 3 | No. 1 | Silicone | 49 | 49 | 0 | Silicone oil | — | — | — | No passing paper | D | D | D | D | — |
| Example 2 | No. 1 | PFA | 61 | 70 | 9 | Monoester wax 1 | 61 | 70 | 9 | A | A | A | B | A | A |
| Example 3 | No. 3 | FEP | 62 | 67 | 5 | Diester wax 3 | 62 | 67 | 5 | A | A | A | B | A | A |
| Example 4 | No. 4 | FEP | 60 | 65 | 5 | Tetraester wax 4 | 60 | 65 | 5 | B | A | A | B | A | A |
| Example 5 | No. 1 | FEP | 69 | 74 | 5 | Tetraester wax 5 | 76 | 79 | 3 | B | B | A | A | A | B |

EXAMPLE 6

An evaluation was performed in the same manner as in Example 1 except that the fixing apparatus of the full-color copying machine CLC-800 used in Example 1 was modified into a fixing apparatus shown in FIG. 2, and that FEP was used for the surface material of the fixing film. Good results were obtained as shown in Table 3.

image was fixed in the same manner as in Example 8 to give a full-color image. As a result, the same good results were obtained as in Example 8.

EXAMPLE 10

Images were formed using one-component developing agent 8 used in Example 9 and a commercially available copying machine NP-8582 (a product of Canon Inc.) having

TABLE 3

| | Developing Agent | Surface Layer Material of Heat Fixing | Contact Angle (°) | | | Releasing Agent Held by Cleaning | Contact Angle (°) | | | OHP light transmittance | Image Uneven Glossiness | Offset Resistance | | Cleaning Property | Feeling of Stickiness of |
|---|---|---|---|---|---|---|---|---|---|---|---|---|---|---|---|
| | No. | Member | A | B | B – A | Member | C | D | D – C | | | 20% | 50% | | OHP Sheet |
| Example 6 | No. 1 | FEP belt | 69 | 74 | 5 | Monoester wax 1 | 69 | 74 | 5 | B | A | A | A | A | A |

EXAMPLE 7

A magenta toner, a yellow toner, and a black toner were prepared in the same manner as in Example 1 except that quinacridone pigment, C. I. pigment yellow 180, and carbon black were used in place of the copper (II) phthalocyanine pigment used in Example 1 respectively. Each toner was mixed with a carrier in the same manner as in Example 1 to give two-component developing agents No. 5, No. 6, and No. 7.

Four color developing agents, i.e., two-component developing agents No. 1, No. 5, No. 6, and No. 7, were used in the commercially available full-color copying machine CLC-800 used in Example 1 to form an unfixed full-color image, and a full-color image was fixed using the same fixing apparatus as used in Example 1. As a result, the pale color reproduction was also excellent, and good results were obtained. When the full-color image was projected using an OHP, a very vivid and excellent projected image was obtained.

EXAMPLE 8

A full-color image forming apparatus using an intermediate transfer medium shown in FIG. 5 was used in place of the commercially available full-color copying machine CLC-800 used in Example 7 to form an unfixed full-color image with the four color developing agents, i.e., two-component developing agents No. 1, No. 5, No. 6, and No. 7, as in Example 7, and a full-color image was obtained using the same fixing apparatus as used in Example 7. As a result, good results were obtained as in Example 7.

EXAMPLE 9

A magnetic toner was prepared in the same manner as in Example 1 except that 200 g of magnetic iron oxide (average particle size: 0.25 μm) treated with a silane coupling agent was used in place of the copper (II) phthalocyanine pigment used in Example 1, and that hydrophobic silica was used as an external additive, and magnetic one-component developing agent 8 shown in Table 3 was obtained.

An unfixed full-color image was formed in the same manner as in Example 8 except that a black developing device 54-4 containing a black toner used in the full-color image forming apparatus used in Example 8 (FIG. 5) was replaced with a developing device for the magnetic one-component developing agent 8, and the unfixed full-color a modified fixing apparatus in which FEP was used as the surface layer of the heating roller serving as the heat fixing member, the cleaning apparatus has a wax pad impregnated with monoester wax 1 as in Example 1, and the cleaning roller has brush-like fibers planted cylindrically on it. Two hundred thousand images were formed. Image uneven glossiness, offset resistance, and cleaning property were evaluated in the same manner as in Example 1, and the stickiness of the OHP sheet was evaluated based on the following evaluation method.

Evaluation Method (6) Stickiness of OHP Sheet

After running on multiple sheets, the apparatus was turned off for 24 hr, and then the power supply switch was turned on again. Then a blank image (solid white image) was formed on a transparent sheet, and the transparent sheet was evaluated in the same manner as in (5) Sticky Feeling of OHP Sheet.

EXAMPLE 11

An evaluation was performed in the same manner as in Example 10 except that paraffin wax 2 (Mw: 570, Mn: 380, Mw/Mn: 1.50, melting point: 69° C., viscosity: 6.8 mPs·s, Vickers hardness: 0.7, and SP value: 8.3) in place of monoester wax 1 was used for the wax pad.

Evaluation results are shown in Table 5.

EXAMPLE 12

An evaluation was performed in the same manner as in Example 10 except that a fractionated paraffin wax 6 (Mw: 580, Mn: 415, Mw/Mn: 1.4, melting point: 70° C., viscosity: 6.8 mPs·s, Vickers hardness: 0.7, and SP value: 8.3) which was obtained by fractionating paraffin wax 2 was used for the wax pad in place of monoester wax 1 used in Example 10.

Evaluation results are shown in Table 5.

EXAMPLE 13

An evaluation was performed in the same manner as in Example 10 except that acrylic modified wax 7 (Mw: 2,100, Mn: 990, Mw/Mn: 2.1, melting point: 94° C., viscosity: 6.8 mPs·s, Vickers hardness: 0.7, and SP value: 10.6) was used for the wax pad in place of monoester wax 1 used in Example 10.

Evaluation results are shown in Table 5.

EXAMPLE 14

An evaluation was performed in the same manner as in Example 10 except that fluorine modified wax 8 (Mw: 600, Mn: 410, Mw/Mn: 1.46, melting point: 95° C., viscosity: 8.3 mPs·s, Vickers hardness: 1.4, and SP value: 8.0) was used for the wax pad in place of monoester wax 1 used in Example 10.

Evaluation results are shown in Table 5.

EXAMPLE 15

An evaluation was performed in the same manner as in Example 10 except that silicone wax 9 (Mw: 1,600, Mn: 1,000, Mw/Mn: 1.6, melting point: 110° C., viscosity: 12 mPs·s, Vickers hardness: 1.5, and SP value: 14.2.) was used for the wax pad in place of monoester wax 1 used in Example 10.

Evaluation results are shown in Table 5.

EXAMPLE 16

An evaluation was performed in the same manner as in Example 10 except that natural carnauba wax 10 (Mw: 900, Mn: 530, Mw/Mn: 1.70, melting point: 65° C., viscosity: 6.3 mPs·s, Vickers hardness: 6.8, and SP value: 8.7) was used for the wax pad in place of monoester wax 1 used in Example 10.

Evaluation results are shown in Table 5.

EXAMPLE 17

An evaluation was performed in the same manner as in Example 10 except that diester wax 3 (Mw: 480, Mn: 410, Mw/Mn: 1.17, melting point: 73° C., viscosity. 10.5 mPs·s, Vickers hardness: 1.0, and SP value: 9.1) was used for the wax pad in place of monoester wax 1 used in Example 10.

Evaluation results are shown in Table 5.

EXAMPLE 18

An evaluation was performed in the same manner as in Example 10 except that tetraester wax 4 (Mw: 430, Mn: 320, Mw/Mn: 1.34, with a shoulder at Mw 850, melting point: 73° C., viscosity: 11.6 mPs·s, Vickers hardness: 1.2, and SP value: 8.5) was used for the wax pad in place of monoester wax 1 used in Example 10.

Evaluation results are shown in Table 5.

EXAMPLE 19

An evaluation was performed in the same manner as in Example 10 except that diester wax 11 (Mw: 1,900, Mn: 1,400, Mw/Mn: 1.36, melting point: 125° C., viscosity: 11.0 mPs·s, Vickers hardness: 1.6, and SP value: 8.6) was used for the wax pad in place of monoester wax 1 used in Example 10.

Evaluation results are shown in Table 5.

EXAMPLE 20

An evaluation was performed in the same manner as in Example 10 except that olefin denatured wax 12 (Mw: 1,800, Mn: 1,280, Mw/Mn: 1.41, melting point: 100° C., viscosity: 12.5 mPs·s, Vickers hardness: 3.2, and SP value: 8.4) was used for the wax pad in place of monoester wax 1 used in Example 10.

Evaluation results are shown in Table 5.

EXAMPLE 21

One-component developing agent No. 9 shown in Table 3 was prepared in the same manner as in Example 10 except that the monomer was changed to 160 g of styrene, 30 g of n-butyl acrylate, and 20 g of methacrylic acid, and was evaluated.

Evaluation results are shown in Table 5.

EXAMPLE 22

An evaluation was performed in the same manner as in Example 10 except that PTFE was used in place of FEP for the surface material of the heating roller.

Evaluation results are shown in Table 5.

EXAMPLE 23

An evaluation was performed in the same manner as in Example 10 except that PFA was used in place of FEP for the surface material of the heating roller.

Evaluation results are shown in Table 5.

Comparative Example 4

An evaluation was performed in the same manner as in Example 10 except that the pad was not impregnated with monoester wax 1 used in Example 10. As a result, the heat fixing member became to have a surface roughness of JIS Rz5 or more by friction with the pad, and stripes were formed in the images.

Evaluation results are shown in Table 5.

Comparative Example 5

An evaluation was performed in the same manner as in Example 10 except that an oil pad (10 mm wide, 310 mm long, and of 1.5 mm thick) made of a nonwoven fabric (available from Nihon Bylean) containing an aromatic polyamide resin and a polyethylene terephthalate resin impregnated for saturation at 120° C. with a silicone oil having a viscosity of 300 centistokes at 25° C., instead of the wax pad. As a result, uneven adhesion of silicone oil occurred to cause in the image uneven stripes due to oil.

Evaluation results are shown in Table 5.

The physical properties of one-component developing agents No. 8 and No. 9 used in Examples 10 to 24 and Comparative Examples 4 and 5 described above are shown in Table 4, and evaluation results in Examples 10 to 24 and Comparative Examples 4 and 5 are shown in Table 5.

TABLE 4

| | Wax | | | | | | | Binding Resin | |
|---|---|---|---|---|---|---|---|---|---|
| | Mw | Mn | Mw/Mn | Melting Point (°C.) | Melting Viscosity mPa · s | Vickers Hardness | SP Value | SP Value | Tg (°C.) |
| Developing Agent No. 8 | 500 | 400 | 1.25 | 70 | 6.5 | 1.1 | 8.6 | 19 | 60 |
| Developing Agent No. 9 | 500 | 400 | 1.25 | 70 | 6.5 | 1.1 | 8.6 | 21.6 | 59 |

TABLE 5

| | Developing Agent | Surface Layer of Heat Fixing | Contact Angle (°) | | | Releasing Agent Held by Cleaning | Contact Angle (°) | | | Image Uneven Glossiness | Offset Resistance | | Cleaning Property | Stickiness of OHP Sheet | Remarks |
|---|---|---|---|---|---|---|---|---|---|---|---|---|---|---|---|
| | No. | Member | A | B | B − A | Member | C | D | D − C | | 20% | 50% | | | |
| Example 10 | No. 8 | FEP | 69 | 74 | 5 | Monoester wax 1 | 69 | 74 | 5 | A | A | A | A | A | |
| Example 11 | No. 8 | FEP | 69 | 74 | 5 | Paraffin wax 2 | 83 | 92 | 9 | B | A | B | B | B | |
| Example 12 | No. 8 | FEP | 69 | 74 | 5 | Fractional paraffin wax 6 | 83 | 92 | 9 | A | A | B | B | A | |
| Example 13 | No. 8 | FEP | 69 | 74 | 5 | Acrylic modified wax 7 | 63 | 70 | 7 | B | A | B | C | B | |
| Example 14 | No. 8 | FEP | 69 | 74 | 5 | Fluorine modified wax 8 | 73 | 85 | 12 | B | A | B | B | B | |
| Example 15 | No. 8 | FEP | 69 | 74 | 5 | Silicone wax 9 | 61 | 62 | 1 | A | A | B | C | A | |
| Example 16 | No. 8 | FEP | 69 | 74 | 5 | Natural carnauba wax 10 | 63 | 69 | 6 | B | A | B | C | B | *2 |
| Example 17 | No. 8 | FEP | 69 | 74 | 5 | Diester wax 3 | 62 | 67 | 5 | A | A | A | A | A | |
| Example 18 | No. 8 | FEP | 69 | 74 | 5 | Tetraester wax 4 | 60 | 65 | 5 | A | A | A | A | A | |
| Example 19 | No. 8 | FEP | 69 | 74 | 5 | Diester wax 11 | 70 | 75 | 5 | B | A | B | C | B | *2 |
| Example 20 | No. 8 | FEP | 69 | 74 | 5 | Olefin modified wax 12 | 71 | 75 | 4 | A | A | A | B | A | *3 |
| Example 21 | No. 9 | FEP | 69 | 74 | 5 | Monoester wax 1 | 69 | 74 | 5 | A | A | A | A | A | |
| Example 22 | No. 8 | PTFE | 83 | 84 | 1 | Monoester wax 1 | 83 | 84 | 1 | A | A | A | A | A | |
| Example 23 | No. 8 | PFA | 61 | 70 | 9 | Monoester wax 1 | 61 | 70 | 9 | A | A | A | A | A | |
| Comparative Example 4 | No. 8 | FEP | 69 | 74 | 5 | None | — | — | — | A | D | D | D | A | *1 |
| Comparative Example 5 | No. 8 | FEP | 69 | 74 | 5 | Silicone oil | — | — | — | A | C | C | D | C | |

Remarks

*1: Scratches (JIS Rz5 or more) were formed on the heat fixing member during an idling operation (even if no paper passed).

*2: Although cleaning property was low in an initial state immediately after a power supply switch was turned on, the cleaning property was recovered with an increase in temperature of the apparatus. The wax locally impregnated in the cleaning member formed scratches (about JIS Rz3) on the heat fixing member.

*3: Although cleaning property was low in an initial state immediately after a power supply switch was turned on, the cleaning property is recovered with an increase in temperature of the apparatus. No scratches were formed on the heat fixing member.

| Example 24 | |
|---|---|
| Styrene-acrylic butyl copolymer weight (Mw: 110,000, Mn: 5,000, Tg: 70° C.) | 100 parts by |

-continued

| Example 24 | |
|---|---|
| Magnetic member weight | 90 parts by |
| Monoazo metal complex weight | 2 parts by |
| Monoester wax 13 weight | 5 parts by |

(Mw: 490, Mn: 415, Mw/Mn: 1.18, melting point: 71° C., viscosity: 11 mPa·s, Vickers hardness: 10.6, and SP value: 9.1)

The above materials were mixed using a Henschel mixer, and then melted and kneaded at 130° C. by a twin-screw extruder. The kneaded mixture was cooled, roughly crushed by a cutter mill, pulverized by a pulverizer using a jet stream, and then classified by a pneumatic classifier to give negatively chargeable insulating magnetic toner particles having a weight average particle size of 6.4 μm. To 100 parts by weight of the magnetic toner particles, 1.0 part by weight of hydrophobic dry silica was externally added using a Henschel mixer to give a magnetic toner, and this magnetic toner was used as one-component developing agent No. 10.

Images were formed on 200,000 sheets using one-component developing agent No. 10 and an image forming apparatus where the fixing apparatus of an commercially available copying machine GP-55 (product of Canon Inc.) was modified to have an arrangement shown in FIG. 6 and a cleaning apparatus using monoester wax 13 in place of silicone oil as a releasing agent impregnated in the web. These images were evaluated in the same manner as in Example 10.

Comparative Example 6

An evaluation was performed in the same manner as in Example 24 except that no wax was impregnated into the web. As a result, the heat fixing member became to have a surface roughness of JIS Rz5 or more by friction with the web within initial 200 sheets running and stripes were formed in images.

Evaluation results are shown in Table 6.

Comparative Example 7

An evaluation was carried out in the same manner as in Example 24 except that silicone oil having a viscosity of 10,000 centistokes at 25° C. was impregnated into the web for saturation at 120° C. in place of monoester wax used in Example 24. As a result, uneven adhesion of silicone oil occurred to cause uneven oil stripes in the image.

Evaluation results are shown in Table 6.

TABLE 6

| | Developing Agent | Surface Layer of Heat Fixing | Contact Angle (°) | | | Releasing Agent Held by Cleaning | Contact Angle (°) | | | Image Uneven Glossiness | Offset Resistance | | Cleaning | Feeling of Stickiness of OHP | |
|---|---|---|---|---|---|---|---|---|---|---|---|---|---|---|---|
| | No. | Member | A | B | B − A | Member | C | D | D − C | | 20% | 50% | Property | Sheet | Remarks |
| Example 24 | No. 9 | FEP | 68 | 73 | 5 | Monoester wax | 69 | 74 | 5 | A | A | A | A | A | |
| Comparative Example 6 | No. 9 | FEP | 68 | 73 | 5 | None | — | — | — | A | D | D | D | A | *1 |
| Comparative Example 7 | No. 9 | FEP | 68 | 73 | 5 | Silicone oil | | | | C | B | B | D | C | |

*1: Scratches (JIS Rz5 or more) were formed on the heat fixing member during an idling operation (even if no paper passed).

What is claimed is:

1. A cleaning apparatus for cleaning a heat fixing member comprising:

a cleaning member to be brought into contact with a surface of a heat fixing member; and a first wax held on said cleaning member, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leqq C \leqq 80°$$

$$10° \geqq D-C \geqq 3°.$$

2. The cleaning apparatus according to claim 1, wherein the first wax has a melting point of 30° to 150° C.

3. The cleaning apparatus according to claim 1, wherein the first wax has a melting point of 50° to 120° C.

4. The cleaning apparatus according to claim 1, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leqq C \leqq 72°$$

$$9° \geqq D-C \geqq 4°.$$

5. The cleaning apparatus according to claim 1, wherein the first wax has, in a molecular weight distribution by GPC, a weight average molecular weight (Mw) of 400 to 4,000 and a number average molecular weight (Mn) of 200 to 4,000.

6. The cleaning apparatus according to claim 1, wherein the first wax has, in a molecular weight distribution by GPC, a weight average molecular weight (Mw) of 400 to 3,000 and a number average molecular weight (Mn) of 200 to 3,000.

7. The cleaning apparatus according to claim 1, wherein the first wax has a weight average molecular weight/number average molecular weight (Mw/Mn) of not more than 2.

8. The cleaning apparatus according to claim 1, wherein the first wax has a weight average molecular weight/number average molecular weight (Mw/Mn) of not more than 1.45.

9. The cleaning apparatus according to claim 1, wherein the first wax has a solubility parameter (SP value) of 7.5 to 16.3.

10. The cleaning apparatus according to claim 1, wherein the first wax has a solubility parameter (SP value) of 8.4 to 10.5.

11. The cleaning apparatus according to claim 1, wherein the first wax has a melting viscosity of 1 to 50 mpas·sec at 100° C.

12. The cleaning apparatus according to claim 1, wherein the first wax has a melting viscosity of 3 to 30 mpas·sec at 100° C.

13. The cleaning apparatus according to claim 1, wherein the first wax has a Vickers hardness of 0.3 to 5.0.

14. The cleaning apparatus according to claim 1, wherein the first wax has a Vickers hardness of 0.5 to 3.0.

15. The cleaning apparatus according to claim 1, wherein the first wax comprises at least one member selected from the group consisting of a paraffin wax, a modified product of paraffin wax, a polyolefine wax, a modified product of polyolefine wax, a higher fatty acid, a metallic salt of higher fatty acid, an amide wax, and an ester wax.

16. The cleaning apparatus according to claim 1, wherein said heat fixing member is a fixing roller in a heat fixing apparatus using a roller heat fixing system.

17. The cleaning apparatus according to claim 1, wherein said heat fixing member is a fixing film in a heat fixing apparatus using a film heat fixing system.

18. The cleaning apparatus according to claim 1, wherein said cleaning member is a cleaning roller on which brush-like fibers are cylindrically fixed, and said cleaning roller is brought into contact with a wax pad impregnated with the first wax by rotation to hold the first wax, and is brought into contact with the surface of said heat fixing member to clean the surface.

19. The cleaning apparatus according to claim 1, wherein said cleaning member is a web, and the web impregnated with the first wax is sequentially delivered to be brought into contact with the surface of said heat fixing member to clean the surface.

20. The cleaning apparatus according to claim 1, wherein said cleaning member is a pad, and the pad impregnated with the first wax is brought into contact with the surface of said heat fixing member to clean the surface.

21. A heat fixing method comprising the steps of:

carrying a toner image formed by a toner on a recording member;

fixing the toner image carried on said recording member to said recording member by bringing a heat fixing member into pressure contact with the toner image; and cleaning a surface of said heat fixing member by a cleaning apparatus, wherein said cleaning apparatus comprises a cleaning member to be brought into contact with the surface of said heat fixing member, and a first wax held on said cleaning member, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leq C \leq 80°$$

$$10° \geq D-C \geq 3°.$$

22. The heat fixing method according to claim 21, wherein the first wax has a melting point of 30° to 150° C.

23. The heat fixing method according to claim 21, wherein the first wax has a melting point of 50° to 120° C.

24. The heat fixing method according to claim 21, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leq C \leq 72°$$

$$9° \geq D-C \geq 4°.$$

25. The heat fixing method according to claim 21, wherein the first wax has, in a molecular weight distribution by GPC, a weight average molecular weight (Mw) of 400 to 4,000 and a number average molecular weight (Mn) of 200 to 4,000.

26. The heat fixing method according to claim 21, wherein the first wax has, in a molecular weight distribution by GPC, a weight average molecular weight (Mw) of 400 to 3,000 and a number average molecular weight (Mn) of 200 to 3,000.

27. The heat fixing method according to claim 21, wherein the first wax has a weight average molecular weight/number average molecular weight (Mw/Mn) of not more than 2.

28. The heat fixing method according to claim 21, wherein the first wax has a weight average molecular weight/number average molecular weight (Mw/Mn) of not more than 1.45.

29. The heat fixing method according to claim 21, wherein the first wax has a solubility parameter (SP value) of 7.5 to 16.3.

30. The heat fixing method according to claim 21, wherein the first wax has a solubility parameter (SP value) of 8.4 to 10.5.

31. The heat fixing method according to claim 21, wherein the first wax has a melting viscosity of 1 to 50 mpas·sec at 100° C.

32. The heat fixing method according to claim 21, wherein the first wax has a melting viscosity of 3 to 30 mpas·sec at 100° C.

33. The heat fixing method according to claim 21, wherein the first wax has a Vickers hardness of 0.3 to 5.0.

34. The heat fixing method according to claim 21, wherein the first wax has a Vickers hardness of 0.5 to 3.0.

35. The heat fixing method according to claim 21, wherein the first wax comprises at least one member selected from the group consisting of a paraffin wax, a modified product of paraffin wax, a polyolefine wax, a modified product of polyolefine wax, a higher fatty acid, a metallic salt of higher fatty acid, an amide wax, and an ester wax.

36. The heat fixing method according to claim 21, wherein said heat fixing member is a fixing roller in a heat fixing apparatus using a roller heat fixing system.

37. The heat fixing method according to claim 21, wherein said heat fixing member is a fixing film in a heat fixing apparatus using a film heat fixing system.

38. The heat fixing method according to claim 21, wherein said cleaning member is a cleaning roller on which brush-like fibers are cylindrically fixed, and said cleaning roller is brought into contact with a wax pad impregnated with the first wax by rotation to hold the first wax, and is brought into contact with the surface of said heat fixing member to clean the surface.

39. The heat fixing method according to claim 21, wherein said cleaning member is a web, and the web impregnated with the first wax is sequentially delivered to be brought into contact with the surface of said heat fixing member to clean the surface.

40. The heat fixing method according to claim 21, wherein said cleaning member is a pad, and the pad impregnated with the first wax is brought into contact with the surface of said heat fixing member to clean the surface.

41. The heat fixing method according to claim 21, wherein the toner contains a coloring agent, a binding resin, and a second wax.

42. The heat fixing method according to claim 41, wherein, when a contact angle between the second wax and said heat fixing member at 100° C. is represented by A, and a contact angle between the second wax and said heat fixing member at 200° C. is represented by B, the contact angles A and B satisfy the following relationship:

$$60° \leq A \leq 80°$$

$$10° \geq B-A \geq 3°.$$

43. The heat fixing method according to claim 41, wherein, when a contact angle between the second wax and said heat fixing member at 100° C. is represented by A, and a contact angle between the second wax and said heat fixing member at 200° C. is represented by B, the contact angles A and B satisfy the following relationship:

$$60° \leq A \leq 72°$$

$$9° \geq B-A \geq 4°.$$

44. The heat fixing method according to claim 41, wherein the second wax has, in a molecular weight distribution by GPC, a weight average molecular weight (Mw) of 400 to 4,000 and a number average molecular weight (Mn) of 200 to 4,000.

45. The heat fixing method according to claim 41, wherein the second wax has, in a molecular weight distribution by GPC, a weight average molecular weight (Mw) of 400 to 3,000 and a number average molecular weight (Mn) of 200 to 3,000.

46. The heat fixing method according to claim 41, wherein the second wax has, in a molecular weight distribution by GPC, a weight average molecular weight (Mw) of 400 to 4,000 and a number average molecular weight (Mn) of 200 to 4,000, and when a contact angle between the second wax and said heat fixing member at 100° C. is represented by A, and a contact angle between the second wax and said heat fixing member at 200° C. is represented by B, the contact angles A and B satisfy the following relationship:

$$60° \leqq A \leqq 80°$$

$$10° \geqq B-A \geqq 3°.$$

47. The heat fixing method according to claim 41, wherein the second wax has, in a molecular weight distribution by GPC, a weight average molecular weight (Mw) of 400 to 4,000 and a number average molecular weight (Mn) of 200 to 4,000, when a contact angle between the second wax and said heat fixing member at 100° C. is represented by A, and a contact angle between the second wax and said heat fixing member at 200° C. is represented by B, the contact angles A and B satisfy the following relationship:

$$60° \leqq A \leqq 80°$$

$$10° \geqq B-A \geqq 3°,$$

and the first wax has, in a molecular weight distribution by GPC, a weight average molecular weight (Mw) of 400 to 4,000 and a number average molecular weight (Mn) of 200 to 4,000.

48. The heat fixing method according to claim 21, wherein the toner image is a full-color toner image consisting of a magenta toner, a cyan toner, and a yellow toner.

49. The heat fixing method according to claim 21, wherein the toner image is a full-color toner image consisting of a magenta toner, a cyan toner, a yellow toner, and a black toner.

50. The heat fixing method according to claim 21, wherein the toner image is a black toner image consisting of a black toner.

51. The heat fixing method according to claim 50, wherein the black toner is a magnetic toner containing a magnetic material.

52. An image forming method comprising the steps of:

forming an electrostatic latent image on a latent image holding member;

developing the electrostatic latent image by a toner to form a toner image;

transferring the toner image to a recording member;

fixing the toner image transferred to said recording member to said recording member by bringing a heat fixing member into pressure contact with the toner image; and cleaning a surface of said heat fixing member by a cleaning apparatus, wherein said cleaning apparatus comprises a cleaning member to be brought into contact with the surface of said heat fixing member, and a first wax held on said cleaning member, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leqq C \leqq 80°$$

$$10° \geqq D-C \geqq 3°.$$

53. The image forming method according to claim 52, wherein the first wax has a melting point of 30° to 150° C.

54. The image forming method according to claim 52, wherein the first wax has a melting point of 50° to 120° C.

55. The image forming method according to claim 52, wherein, when a contact angle between the first wax and said heat fixing member at 100° C. is represented by C, and a contact angle between the first wax and said heat fixing member at 200° C. is represented by D, the contact angles C and D satisfy the following relationship:

$$60° \leqq C \leqq 72°$$

$$9° \geqq D-C \geqq 4°.$$

56. The image forming method according to claim 52, wherein the first wax has, in a molecular weight distribution by GPC, a weight average molecular weight (Mw) of 400 to 4,000 and a number average molecular weight (Mn) of 200 to 4,000.

57. The image forming method according to claim 52, wherein the first wax has, in a molecular weight distribution by GPC, a weight average molecular weight (Mw) of 400 to 3,000 and a number average molecular weight (Mn) of 200 to 3,000.

58. The image forming method according to claim 52, wherein the first wax has a weight average molecular weight/number average molecular weight (Mw/Mn) of not more than 2.

59. The image forming method according to claim 52, wherein the first wax has a weight average molecular weight/number average molecular weight (Mw/Mn) of not more than 1.45.

60. The image forming method according to claim 52, wherein the first wax has a solubility parameter (SP value) of 7.5 to 16.3.

61. The image forming method according to claim 52, wherein the first wax has a solubility parameter (SP value) of 8.4 to 10.5.

62. The image forming method according to claim 52, wherein the first wax has a melting viscosity of 1 to 50 mpas·sec at 100° C.

63. The image forming method according to claim 52, wherein the first wax has a melting viscosity of 3 to 30 mpas·sec at 100° C.

64. The image forming method according to claim 52, wherein the first wax has a Vickers hardness of 0.3 to 5.0.

65. The image forming method according to claim 52, wherein the first wax has a Vickers hardness of 0.5 to 3.0.

66. The image forming method according to claim 52, wherein the first wax consists of at least one member selected from the group consisting of a paraffin wax, a modified product of paraffin wax, a polyolefine wax, a modified product of polyolefine wax, a higher fatty acid, a metallic salt of higher fatty acid, an amide wax, and an ester wax.

67. The image forming method according to claim 52, wherein said heat fixing member is a fixing roller in a heat fixing apparatus using a roller heat fixing system.

68. The image forming method according to claim 52, wherein said heat fixing member is a fixing film in a heat fixing apparatus using a film heat fixing system.

69. The image forming method according to claim 52, wherein said cleaning member is a cleaning roller on which brush-like fibers are cylindrically fixed, and said cleaning roller is brought into contact with a wax pad impregnated with the first wax by rotation to hold the first wax, and is brought into contact with the surface of said heat fixing member to clean the surface.

70. The image forming method according to claim 52, wherein said cleaning member is a web, and the web impregnated with the first wax is sequentially delivered to be brought into contact with the surface of said heat fixing member to clean the surface.

71. The image forming method according to claim 52, wherein said cleaning member is a pad, and the pad impregnated with the first wax is brought into contact with the surface of said heat fixing member to clean the surface.

72. The image forming method according to claim 52, wherein the toner contains a coloring agent, a binding resin, and a second wax.

73. The image forming method according to claim 72, wherein, when a contact angle between the second wax and said heat fixing member at 100° C. is represented by A, and a contact angle between the second wax and said heat fixing member at 200° C. is represented by B, the contact angles A and B satisfy the following relationship:

$$60° \leqq A \leqq 80°$$

$$10° \geqq B-A \geqq 3°.$$

74. The image forming method according to claim 72, wherein, when a contact angle between the second wax and said heat fixing member at 100° C. is represented by A, and a contact angle between the second wax and said heat fixing member at 200° C. is represented by X, the contact angles A and B satisfy the following relationship:

$$60° \leqq A \leqq 72°$$

$$9° \geqq B-A \geqq 4°.$$

75. The image forming method according to claim 72, wherein the second wax has, in a molecular weight distribution by GPC, a weight average molecular weight (Mw) of 400 to 4,000 and a number average molecular weight (Mn) of 200 to 4,000.

76. The image forming method according to claim 72, wherein the second wax has, in a molecular weight distribution by GPC, a weight average molecular weight (Mw) of 400 to 3,000 and a number average molecular weight (Mn) of 200 to 3,000.

77. The image forming method according to claim 72, wherein the second wax has, in a molecular weight distribution by GPC, a weight average molecular weight (Mw) of 400 to 4,000 and a number average molecular weight (Mn) of 200 to 4,000, and when a contact angle between the second wax and said heat fixing member at 100° C. is represented by A, and a contact angle between the second wax and said heat fixing member at 200° C. is represented by B, the contact angles A and B satisfy the following relationship:

$$60° \leqq A \leqq 80°$$

$$10° \geqq B-A \geqq 3°.$$

78. The image forming method according to claim 72, wherein the second wax has, in a molecular weight distribution by GPC, a weight average molecular weight (Mw) of 400 to 4,000 and a number average molecular weight (Mn) of 200 to 4,000, when a contact angle between the second wax and said heat fixing member at 100° C. is represented by A, and a contact between the second wax and said heat fixing member at 200° C. is represented by B, the contact angles A and B satisfy the following relationship:

$$60° \leqq A \leqq 80°$$

$$10° \geqq B-A \geqq 3°,$$

and the first wax has, in a molecular weight distribution by GPC, a weight average molecular weight (Mw) of 400 to 4,000 and a number average molecular weight (Mn) of 200 to 4,000.

79. The image forming method according to claim 52, wherein the toner image is a full-color toner image consisting of a magenta toner, a cyan toner, and a yellow toner.

80. The image forming method according to claim 52, wherein the toner image is a full-color toner image consisting of a magenta toner, a cyan toner, a yellow toner, and a black toner.

81. The image forming method according to claim 52, wherein the toner image is a black toner image consisting of a black toner.

82. The image forming method according to claim 81, wherein the black toner is a magnetic toner containing a magnetic material.

83. The image forming method according to claim 52, which has a first transfer step of transferring the toner image formed on said latent image holding member to an intermediate transfer medium and a second transfer step of transferring the toner image transferred to said intermediate transfer medium to said recording medium.

84. A heat fixing method comprising the steps of:

carrying a toner image formed by a toner on a recording member;

wherein the toner contains a coloring agent, a binding resin and a second wax;

fixing the toner image carried on said recording member to said recording member by bringing a heat fixing member into pressure contact with the toner image; and cleaning a surface of said heat fixing member by a cleaning apparatus, wherein said cleaning apparatus comprises a cleaning member to be brought into contact with the surface of said heat fixing member, and a first wax held on said cleaning member;

wherein, when a contact angle between the second wax and said heat fixing member at 100° C. is represented by A, and a contact angle between the second wax and said heat fixing member at 200° C. is represented by B, the contact angles A and B satisfy the following relationship:

$60° \leqq A \leqq 80°$ $10° \geqq B-A \geqq 3°$.

85. The heat fixing method according to claim 84, wherein the first wax has a melting point of 30° to 150° C.

86. The heat fixing method according to claim 84, wherein the first wax has a melting point of 50° to 120° C.

87. The heat fixing method according to claim 84, wherein the first wax has, in a molecular weight distribution by GPC, a weight average molecular weight (Mw) of 400 to 4,000 and a number average molecular weight (Mn) of 200 to 4,000.

88. The heat fixing method according to claim 84, wherein the first wax has a weight average molecular weight/number average molecular weight (Mw/Mn) of not more than 2.

89. The heat fixing method according to claim 84, wherein the first wax has a solubility parameter (SP value) of 7.5 to 16.3.

90. The heat fixing method according to claim 84, wherein the first wax has a melting viscosity of 1 to 50 mpas·sec at 100° C.

91. The heat fixing method according to claim 84, wherein the first wax has a Vickers hardness of 0.3 to 5.0.

92. The heat fixing method according to claim 84, wherein the first wax comprises at least one member selected from the group consisting of a paraffin wax, a modified product of paraffin wax, a polyolefine wax, a modified product of polyolefine wax, a higher fatty acid, a metallic salt of higher fatty acid, an amide wax, and an ester wax.

93. The heat fixing method according to claim 84, wherein said heat fixing member is a fixing roller in a heat fixing apparatus using a roller heat fixing system.

94. The heat fixing method according to claim 84, wherein said heat fixing member is a fixing film in a heat fixing apparatus using a film heat fixing system.

95. The heat fixing method according to claim 84, wherein said cleaning member is a cleaning roller on which brush-like fibers are cylindrically fixed, and said cleaning roller is brought into contact with a wax pad impregnated with the first wax by rotation to hold the first wax, and is brought into contact with the surface of said heat fixing member to clean the surface.

96. The heat fixing method according to claim 84, wherein said cleaning member is a web, and the web impregnated with the first wax is sequentially delivered to be brought into contact with the surface of said heat fixing member to clean the surface.

97. The heat fixing method according to claim 84, wherein said cleaning member is a pad, and the pad impregnated with the first wax is brought into contact with the surface of said heat fixing member to clean the surface.

98. The heat fixing method according to claim 84, wherein, when a contact angle between the second wax and said heat fixing member at 100° C. is represented by A, and a contact angle between the second wax and said heat fixing member at 200° C. is represented by B, the contact angles A and B satisfy the following relationship:

$60° \leqq A \leqq 72°$ $90 \geqq B-A \geqq 4°$.

99. The heat fixing method according to claim 84, wherein the second wax has, in a molecular weight distribution by GPC, a weight average molecular weight (Mw) of 400 to 4,000 and a number average molecular weight (Mn) of 200 to 4,000.

100. The heat fixing method according to claim 84, wherein the toner image is a full-color toner image consisting of a magenta toner, a cyan toner, and a yellow toner.

101. The heat fixing method according to claim 84, wherein the toner image is a full-color toner image consisting of a magenta toner, a cyan toner, a yellow toner, and a black toner.

102. The heat fixing method according to claim 84, wherein the toner image is a black toner image consisting of a black toner.

103. The heat fixing method according to claim 102, wherein the black toner is a magnetic toner containing a magnetic material.

104. An image forming method comprising the steps of:

forming an electrostatic latent image on a latent image holding member;

developing the electrostatic latent image by a toner to form a toner image;

wherein the toner contains a coloring agent, a binding resin, and a second wax;

transferring the toner image to a recording member;

fixing the toner image transferred to said recording member to said recording member by bringing a heat fixing member into pressure contact with the toner image; and cleaning a surface of said heat fixing member by a cleaning apparatus, wherein said cleaning apparatus comprises a cleaning member to be brought into contact with the surface of said heat fixing member, and a first wax held on said cleaning member;

wherein, when a contact angle between the second wax and said heat fixing member at 100° C. is represented by A, and a contact angle between the second wax and said heat fixing member at 200° C. is represented by B, the contact angles A and B satisfy the following relationship:

$60° \leqq A \leqq 80°$ $10° \geqq B-A \geqq 3°$.

105. The image forming method according to claim 104, wherein the first wax has a melting point of 30° to 150° C.

106. The image forming method according to claim 104, wherein the first wax has a melting point of 50° to 120° C.

107. The image forming method according to claim 104, wherein the first wax has, in a molecular weight distribution by GPC, a weight average molecular weight (Mw) of 400 to 4,000 and a number average molecular weight (Mn) of 200 to 4,000.

108. The image forming method according to claim 104, wherein the first wax has a weight average molecular weight/number average molecular weight (Mw/Mn) of not more than 2.

109. The image forming method according to claim 104, wherein the first wax has a solubility parameter (SP value) of 7.5 to 16.3.

110. The image forming method according to claim 104, wherein the first wax has a melting viscosity of 1 to 50 mpas·sec at 100° C.

111. The image forming method according to claim 104, wherein the first wax has a Vickers hardness of 0.3 to 5.0.

112. The image forming method according to claim 104, wherein the first wax consists of at least one member selected from the group consisting of a paraffin wax, a modified product of paraffin wax, a polyolefine wax, a modified product of polyolefine wax, a higher fatty acid, a metallic salt of higher fatty acid, an amide wax, and an ester wax.

113. The image forming method according to claim 104, wherein said heat fixing member is a fixing roller in a heat fixing apparatus using a roller heat fixing system.

114. The image forming method according to claim 104, wherein said heat fixing member is a fixing film in a heat fixing apparatus using a film heat fixing system.

115. The image forming method according to claim 104, wherein said cleaning member is a cleaning roller on which brush-like fibers are cylindrically fixed, and said cleaning roller is brought into contact with a wax pad impregnated with the first wax by rotation to hold the first wax, and is brought into contact with the surface of said heat fixing member to clean the surface.

116. The image forming method according to claim 104, wherein said cleaning member is a web, and the web impregnated with the first wax is sequentially delivered to be brought into contact with the surface of said heat fixing member to clean the surface.

117. The image forming method according to claim 104, wherein said cleaning member is a pad, and the pad impregnated with the first wax is brought into contact with the surface of said heat fixing member to clean the surface.

118. The image forming method according to claim 104, wherein, when a contact angle between the second wax and said heat fixing member at 100° C. is represented by A, and a contact angle between the second wax and said heat fixing member at 200° C. is represented by B, the contact angles A and B satisfy the following relationship:

$$60° \leqq A \leqq 72°$$

$$9 \geqq B - A \geqq 4°.$$

119. The image forming method according to claim 104, wherein the second wax has, in a molecular weight distribution by GPC, a weight average molecular weight (Mw) of 400 to 4,000 and a number average molecular weight (Mn) of 200 to 4,000.

120. The image forming method according to claim 104, wherein the toner image is a full-color toner image consisting of a magenta toner, a cyan toner, and a yellow toner.

121. The image forming method according to claim 104, wherein the toner image is a full-color toner image consisting of a magenta toner, a cyan toner, a yellow toner, and a black toner.

122. The image forming method according to claim 104, wherein the toner image is a black toner image consisting of a black toner.

123. The image forming method according to claim 122, wherein the black toner is a magnetic toner containing a magnetic material.

124. The image forming method according to claim 104, which has a first transfer step of transferring the toner image formed on said latent image holding member to an intermediate transfer medium and a second transfer step of transferring the toner image transferred to said intermediate transfer medium to said recording medium.

* * * * *

UNITED STATES PATENT AND TRADEMARK OFFICE

CERTIFICATE OF CORRECTION

PATENT NO. : 5,802,440

DATED : September 1, 1998

INVENTOR : RYUICHIRO MAEYAMA

It is certified that error appears in the above-identified patent and that said Letters Patent is hereby corrected as shown below:

On the title page item [73] Assignee

"Canon Kabushiki Kaisha, Japan should read --Canon Kabushiki Kaisha, Tokyo, Japan--.

COLUMN 2,
Line 53, "sticky a" should read --a sticky--; and
Line 64, "and," should read --and--.

COLUMN 6,
Line 48, "20°C." should read --200°C.--;
Line 59, "30°" should read --3°--; and
Line 64, "9° ≥ D-C 4°" should read --9° ≥ D-C ≥ 4°--.

COLUMN 7,
Line 28, "resistances With" should read --resistance.--
¶ With--;
Line 30, "too" should be deleted; and
Line 58, "MW" should read Mw--.

COLUMN 8,
Line 47, "Vickers" should read --vickers-- .

COLUMN 9,
Line 35, "color-toner" should read --color toner--;
Line 37, "and" should read --and to--; and
Line 56, "cover" should read --covers--.

UNITED STATES PATENT AND TRADEMARK OFFICE

CERTIFICATE OF CORRECTION

PATENT NO. : 5,802,440

DATED : September 1, 1998

INVENTORS : RYUICHIRO MAEYAMA

It is certified that error appears in the above-identified patent and that said Letters Patent is hereby corrected as shown below:

COLUMN 10,
Line 12, "reproducibility:" should read --reproducibility--; and
Line 58, "contact-charing" should read --contact-charging--.

COLUMN 11,
Line 58, "transfer" should read --transfers--.

COLUMN 12,
Line 41, "process:it" should read --process. It--.

COLUMN 13,
Line 36, "weight;" should red --weight,--; and "preferable," should read --preferably--; and
Line 54, "In" should read --in--.

COLUMN 14,
Line 62, Close up right margin.

COLUMN 15,
Line 19, "An" should read --an--.

COLUMN 17,
Line 27, "toner:" should read --toner--.

UNITED STATES PATENT AND TRADEMARK OFFICE

CERTIFICATE OF CORRECTION

PATENT NO. : 5,802,440

DATED : September 1, 1998

INVENTORS : RYUICHIRO MAEYAMA

It is certified that error appears in the above-identified patent and that said Letters Patent is hereby corrected as shown below:

COLUMN 18,
Line 41, "monomer," should read --monomer--.

COLUMN 19,
Line 18, "copolymer" should read --copolymers--; and
Line 21, "initiator" should read --initiators--.

COLUMN 22,
Line 14, "controlling" should read --control--; and
Line 20, "previously;" should read --previously--.

COLUMN 26,
Line 38, "heating-types" should read --heating types--; and
Line 63, "guiding" should read --guided--.

COLUMN 28,
Line 11, "with,"should read --with--; and
Line 28, Close up right margin.

COLUMN 29,
Line 5, "a" should read --an--; and
Line 66, "toner," should read --toner--.

COLUMN 31,
Line 31, "SA" should read --5A--.

UNITED STATES PATENT AND TRADEMARK OFFICE

CERTIFICATE OF CORRECTION

PATENT NO. : 5,802,440

DATED : September 1, 1998

INVENTORS : RYUICHIRO MAEYAMA

It is certified that error appears in the above-identified patent and that said Letters Patent is hereby corrected as shown below:

Column 33

Line 11, "applicable" should read --applicable.--.

COLUMN 36,
Line 2, "composition" should read --composition was--.

COLUMN 39,
Line 4, "were" should read --was--.

COLUMN 42,
Line 34, "24 hr," should read --24 hrs.,--.

COLUMN 47,
Line 3, "an" should read --a--.

COLUMN 49,
Line 24, "comprises" should read --comprises:--.

COLUMN 52,
Line 3, "comprises" should read --comprises:--.

COLUMN 54,
Line 16, "contact" should read --contact angle--; and
Line 57, "comprises" should read --comprises:--.

UNITED STATES PATENT AND TRADEMARK OFFICE

CERTIFICATE OF CORRECTION

PATENT NO. : 5,802,440

DATED : September 1, 1998

INVENTORS : RYUICHIRO MAEYAMA

It is certified that error appears in the above-identified patent and that said Letters Patent is hereby corrected as shown below:

COLUMN 55,
Line 59, "90 ≥ B-A ≥ 4°." should read --9° ≥ B-A ≥ 4°.--.

COLUMN 56,
Line 25, "comprises" should read --comprises:--.

COLUMN 58,
Line 2, "9 ≥ B-A ≥ 4°." should read --9° ≥ B-A ≥ 4°.--.

Signed and Sealed this

Fifteenth Day of June, 1999

*Attest:*

Q. TODD DICKINSON

*Attesting Officer*

*Acting Commissioner of Patents and Trademarks*